US007675491B2

(12) United States Patent
Ogura

(10) Patent No.: US 7,675,491 B2
(45) Date of Patent: Mar. 9, 2010

(54) DISPLAY DEVICE AND METHOD FOR DRIVING THE SAME

(75) Inventor: Jun Ogura, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 537 days.

(21) Appl. No.: 11/715,739

(22) Filed: Mar. 8, 2007

(65) Prior Publication Data

US 2007/0210995 A1 Sep. 13, 2007

(30) Foreign Application Priority Data

Mar. 10, 2006 (JP) ..... 2006-065165

(51) Int. Cl.
*G09G 3/30* (2006.01)

(52) U.S. Cl. ..... 345/76; 345/89; 345/95; 345/204; 345/210; 345/690

(58) Field of Classification Search ..... 345/76–84, 345/87–100, 204–215, 690–699
See application file for complete search history.

(56) References Cited

U.S. PATENT DOCUMENTS

2006/0221015 A1* 10/2006 Shirasaki et al. ..... 345/77
2007/0080905 A1* 4/2007 Takahara ..... 345/76
2008/0238953 A1* 10/2008 Ogura ..... 345/697

* cited by examiner

*Primary Examiner*—Vijay Shankar
(74) *Attorney, Agent, or Firm*—Frishauf, Holtz, Goodman & Chick, P.C.

(57) ABSTRACT

A display device includes a pixel array in which a plurality of display pixels are arranged in a two-dimensional manner which is divided into a plurality of column groups composed of the display pixels of a predetermined number of columns, a signal drive circuit which produces a signal current based on display data, and sequentially outputs, in time series via a common terminals, the signal current that corresponds to the display pixels for one row of the pixel array for each of signal currents that correspond to each of the column groups, and a current latch circuit which sequentially captures and holds the signal currents output from the signal drive circuit for one row of the pixel array, generates gradation currents and simultaneously supplies the gradation currents to the plurality of data lines, wherein the pixel array and the current latch circuit are formed on a display panel substrate.

26 Claims, 16 Drawing Sheets

DISPLAY DEVICE AND METHOD FOR DRIVING THE SAME

CROSS-REFERENCE TO RELATED APPLICATIONS

This application is based upon and claims the benefit of priority from prior Japanese Patent Application No. 2006-065165, filed Mar. 10, 2006, the entire contents of which are incorporated herein by reference.

BACKGROUND OF THE INVENTION

1. Field of the Invention

The present invention relates to a display device and a method for driving the display device, and particularly to a display device which comprises a display panel on which there are arranged a plurality of display pixels provided with current control type light emitting elements that emit light at a predetermined luminance gradation by supplying a current responsive to display data, and a method for driving the display device.

2. Description of the Related Art

Conventionally, there has been known a light emission type display (display device) that comprises a display panel on which there are arranged, in a two-dimensional manner, a plurality of display pixels provided with current control type light emitting elements that emit light at a predetermined luminance gradation responsive to a current value of supplied driving current, like organic electroluminescence elements (hereinafter, abbreviated as "organic EL elements) or light emitting diodes (LEDs).

In particular, in a light emitting element type display having applied an active matrix type driving system, a display response speed is fast with no viewing angle dependency in comparison with a liquid crystal display device (LCD) that has been prevalent in recent years. In addition, this light emitting type display enables high luminance or high contrast, high quality and resolution of display image, and low power consumption and is composed of light emitting element type display pixels. Thus, there is no need for backlight unlike the case of the liquid crystal display device. Therefore, the light emitting element type display has a very advantageous feature that it enables further downsizing and reduction in weight or power saving and is actively researched and developed as a next generation display.

FIG. 16 is a schematic view showing an exemplary configuration of essential portions of a light emitting element type display in a conventional technique.

As shown in FIG. 16, the light emitting type display in the conventional technique has a configuration provided with: a display panel 110P on which a plurality of display pixels EMp provided with current control type light emitting elements (for example, organic EL elements) are arranged in a matrix manner in the vicinity of cross points between a plurality of scanning lines (gate signal lines) SLp and a plurality of data lines (source signal lines DLp that are arranged so as to be orthogonal to each other; a scanning driver (gate driver) 120P connected via a contact point NSp to the scanning lines SLp of the display panel 110 and setting (scanning) the display pixels EMp per line in an active state by sequentially applying a scan signal Vsel with a predetermined timing to each of the scanning lines SLp; and a data driver (signal driver circuit) 130P connected via a contact point NDp to the data lines DLp of the display panel 110P and capturing display data (or video data) to supply to each of the data lines DLp, with a predetermined timing, a gradation signal responsive to display data.

In such a display, for example, operating states of the scanning driver 120P and the data driver 130P are controlled based on signals such as a scan control signal and a data control signal supplied from a timing control circuit (such as system controller), although not shown. Then, a gradation signal responsive to display data is written and held in display pixels EMp of each line set at an active state by applying a scan signal Vsel. In this manner, the light emitting elements provided to display pixels EMp are operated to emit light during a predetermined period and at a predetermined luminance gradation, thereby making it possible to achieve an active matrix type driving system for displaying desired image information.

In addition to the light emitting elements (organic EL elements) described above, the configuration for achieving the driving system described above is provided with a pixel driver circuit (or pixel circuit) made of a plurality of switching elements (such as thin film transistors) for controlling light emission by supplying to the light emitting elements a light emitting drive current with a current value responsive to display data for each of the display pixels EMp arranged on the display panel 110P.

Here, as shown in FIG. 16, the above configuration is provided so that the gradation current generated by means of the data driver 130P (a plurality of gradation current generating circuits) is output to each of the data lines DLp arranged on the display panel 110P in a relationship of 1:1 via an individual contact point (connector terminal) NDp. Thus, in the case where high resolution has been achieved by increasing the number of data lines arranged on the display panel, the number of output terminals of the data driver also increases corresponding to the number of data lines. In addition, the number of connector terminals between the data driver and the display panel (panel substrate) provided as driver chips (IC chips) increases. Therefore, there has been a problem that pitches (gaps) between terminals narrow, requiring high precision of alignment in a process for connecting the driver chips and an increased number of man-days or the like, resulting in higher manufacturing costs.

BRIEF SUMMARY OF THE INVENTION

The present invention has an advantage that there can be provided a display device and a method for driving the display device for driving a display panel to emit light in a current specifying system, wherein, even in the case where the display panel has a high resolution, a display panel substrate and a signal driver circuit can be easily connected to each other in a simplified manner and a good image display can be achieved.

In order to achieve the above-described advantage, a first display device of the invention comprises: a pixel array in which a plurality of display pixels are arranged in a two-dimensional manner in the vicinity of cross points between a plurality of scanning lines arranged in a row direction and a plurality of data lines arranged in a column direction which is divided into a plurality of column groups composed of the display pixels of a predetermined number of columns; a signal drive circuit which produces a signal current for controlling display gradation of the plurality of display pixels based on display data, and sequentially outputs, in time series via a common terminals, the signal current that corresponds to the display pixels for one row of the pixel array for each of signal currents that correspond to each of the column groups; and a current latch circuit which sequentially captures the signal currents output from the signal drive circuit, holds the signal current for one row of the pixel array, generates gradation currents that correspond to the display pixels for one row of the pixel array, based on the held signal current, and then, simultaneously supplies the generated gradation currents to the plurality of data lines, wherein the pixel array and the current latch circuit are formed on a display panel substrate.

In order to achieve the above-described advantage, a second display device of the invention comprises: a pixel array in which a plurality of display pixels are arranged in a two-dimensional manner in the vicinity of cross points between a plurality of scanning lines arranged in a row direction and a plurality of data lines arranged in a column direction which is divided into a plurality of column groups composed of the display pixels of a predetermined number of columns; a scan drive circuit which sequentially applies scan signals to each of the plurality of scanning lines, and then, selectively sets the display pixels of each row of the pixel array at an active state; a signal drive circuit which produces a signal current that controls display gradation of the plurality of display pixels, based on display data, and then, sequentially outputs the signal current that corresponds to the display pixels for one row of the display array, via output terminals, the number of which is equal to the number of the columns included in the column group, by signal currents corresponding to each of the column groups; and a current latch circuit having input terminals, the number of which is equal to that of the output terminals, the input terminals being connected to the output terminals, and a plurality of current capturing circuit portions and current latch circuit portions that correspond to each of the plurality of column groups, the current latch circuit sequentially capturing the signal currents produced via the input terminals in each of the current latch circuits via each of the current capturing circuit portions; holding a signal current for one row of the pixel array and generating a gradation current that corresponds to the display pixels for one row of the pixel array, based on the held signal current, in parallel to each other, the current latch circuit simultaneously supplying the generated gradation current to the plurality of data lines in accordance with a timing of setting the display pixels of each row at an active state by the scan drive circuit; and wherein the pixel array and the current latch circuit are formed on a display panel substrate, and each of the output terminals of the signal drive circuit is electrically connected to each of the input terminals of the current latch circuit.

In order to achieve the above-described advantage, a driving method of the invention comprises: the display device having a pixel array in which a plurality of display pixels are arranged in a two dimensional manner which is divided into a plurality of column groups composed of the display pixels of a predetermined number of columns, the pixel array being formed on a display panel substrate, and a current latch circuit formed on the display panel substrate which generates a gradation current that is based on display data, and then, supplies the generated gradation current to the plurality of display pixels; by means of a signal drive circuit provided outside the display panel substrate, generating a signal current for controlling display gradation of the display pixels of each row of the pixel array, based on the display data, and then, sequentially outputting, in time series via a common terminals, the signal current that corresponds to the display pixels for one row of the pixel array by signal currents that correspond to each of the column groups; and by means of a current latch circuit, sequentially capturing the signal currents, holding the signal current for one row of the pixel array, generating the gradation currents that correspond to the display pixels for one row of the pixel array, based on the held signal current, and then, simultaneously supplying the generated gradation currents to each of the display pixels of the row.

DETAILED DESCRIPTION OF THE INVENTION

Hereinafter, a display device and a method for driving the display device according to the present invention will be described in detail by way of embodiments shown in the accompanying drawings.

First Embodiment

<Display Device>

Figure 1:
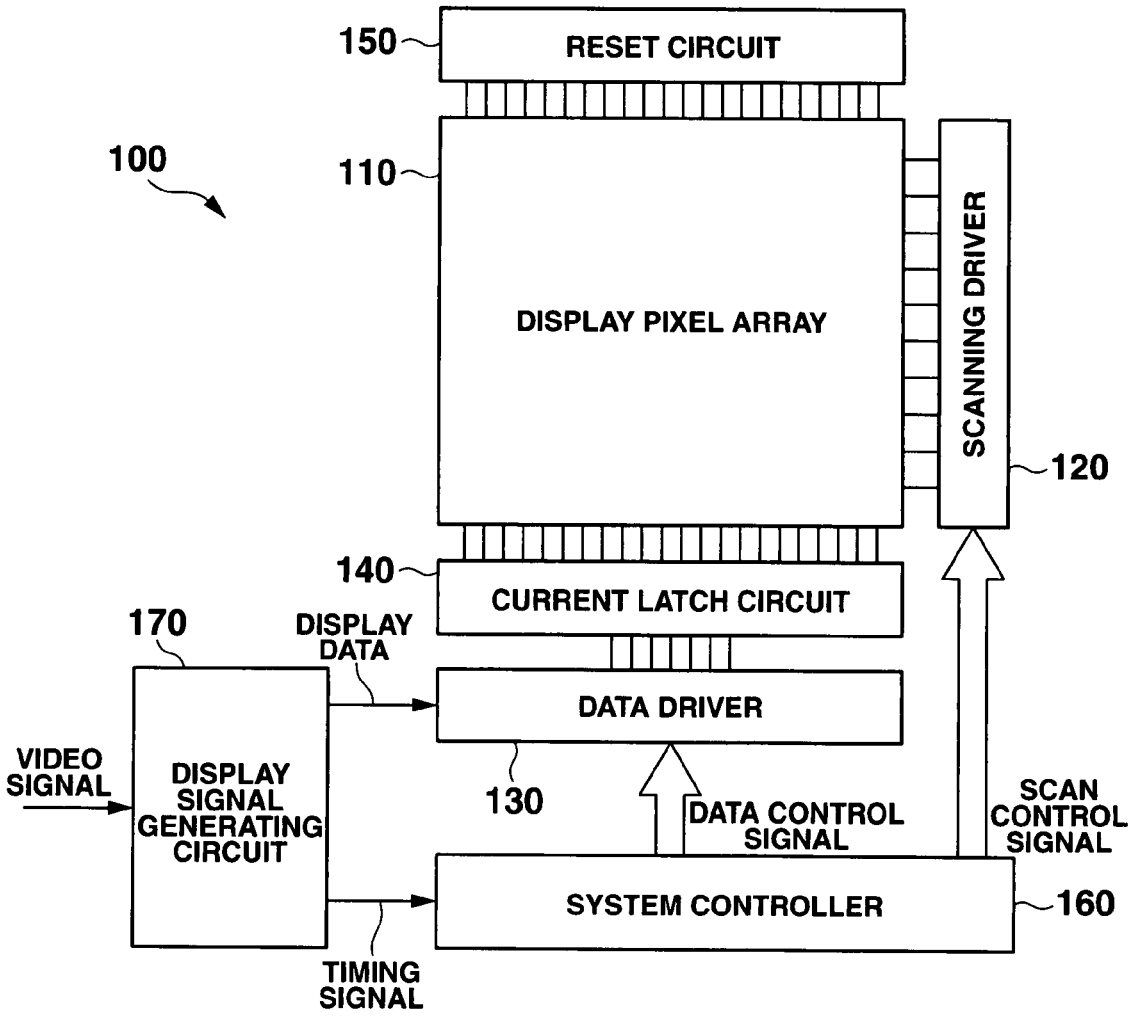
FIG. 1 is a schematic block diagram depicting a whole configuration in one embodiment of a display device according to the present invention.

FIG. 1 is a schematic block diagram depicting a whole configuration in one embodiment of a display device according to the present invention.

Figure 2:
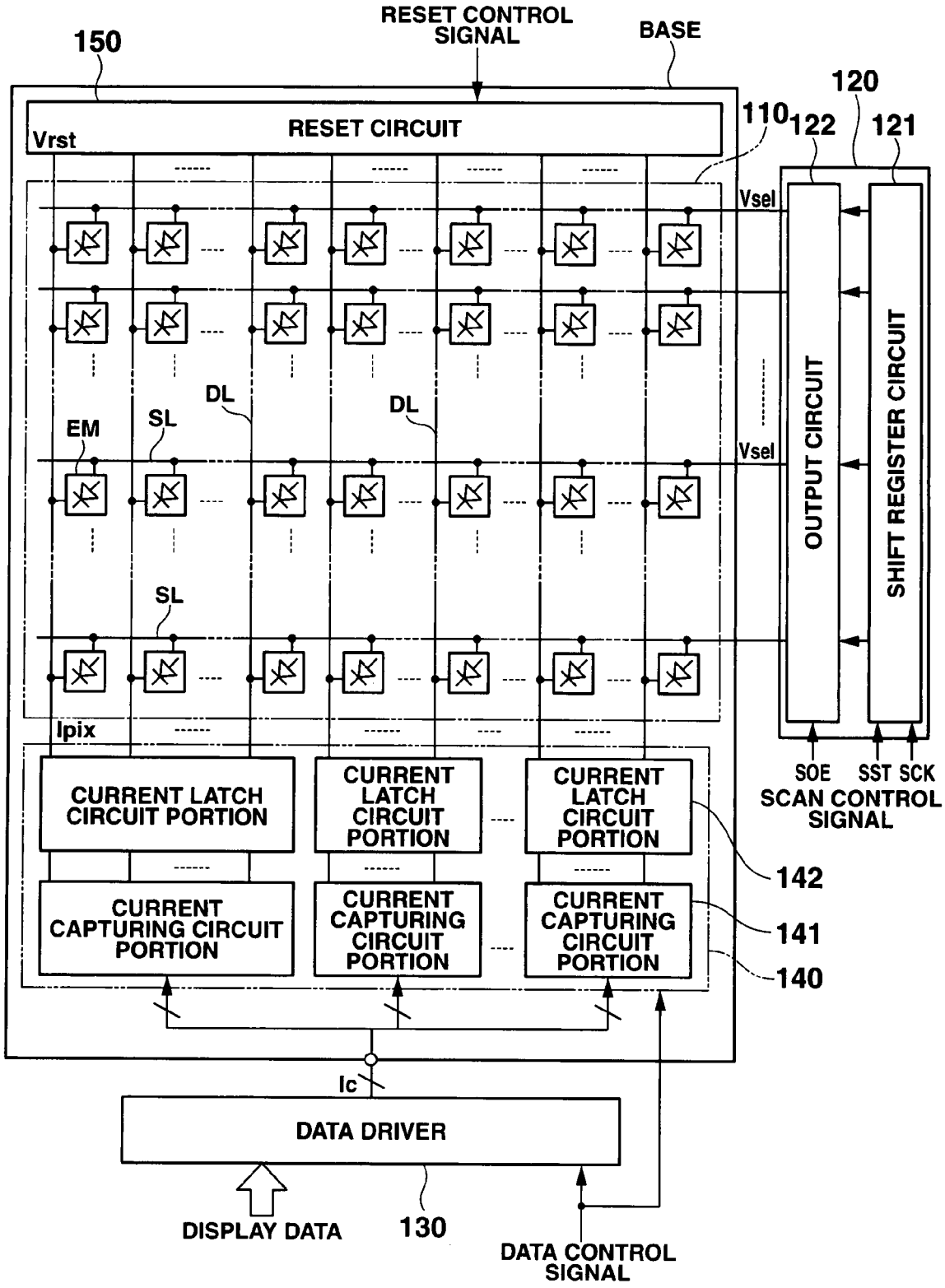
FIG. 2 is a schematic diagram of essential portions showing one embodiment of the display device according to the present invention.

FIG. 2 is a schematic view of essential portions showing one embodiment of the display device according to the present invention.

As shown in FIGS. 1 and 2, a display device 100 according to one embodiment of the present invention is composed of: a display pixel array (display panel) 110; a scanning driver (scanning drive circuit) 120; a data driver (signal drive circuit) 130; a current latch circuit (gradation current output circuit) 140; a reset circuit 150; a system controller 160; and a display signal generating circuit 170.

The display pixel array 110 is featured in that a plurality of display pixels EM are arranged in a matrix manner (n rows×m columns: n and m are positive integers) in the vicinity of cross points of a plurality of scanning lines SL and a plurality of data lines DL arranged so as to be orthogonal to each other.

The scanning driver 120 is connected to each of the scanning lines SL of the display pixel array 110 via an external terminal, although not shown. A scan signal Vsel is applied to each of the scanning lines SL with a predetermined timing, thereby sequentially setting the display pixels EM of each row in an active state.

The data driver 130 captures display data supplied from the display signal generating circuit 170; generates a signal current Ic that has a current value responsive to the display data, and supplies the generated current to the current latch circuit 140 in units of the column groups described above.

The current latch circuit 140 is connected to each of the data lines DL of the display pixel array 110. This circuit captures and holds a signal current Ic by a predetermined column group (block) made of a plurality of data lines DL, the signal current being responsive to display data supplied from the data driver 130 described later. In addition, this circuit simultaneously supplies to the data lines DL a gradation current Ipix responsive to the held signal current Ic (display data).

The reset circuit 150 is connected to each of the data lines DL of the display pixel array 110. This circuit applies a reset voltage Vrst to each of the data lines DL with a predetermined timing, thereby discharging electric charge (voltage component) that remains in the display pixel EM and setting a current state to a reset state (initialized state).

The system controller 160 generates and outputs a variety of control signals (such as scan control signal, data control signal, and reset control signal) that control operating states of at least the scanning driver 120, the data driver 130, the current latch circuit 140, and the reset circuit 150, based on a timing signal supplied from the display generating circuit 170, for example.

The display signal generating circuit 170 generates display data (luminance gradation signal made of digital data) and supplies the generated data to the data driver 130 based on a video signal supplied from the outside of the display device 100, for example. In addition, this circuit generates or samples a timing signal (such as system clock) for displaying the display data as an image on the display pixel array 110, and then, supplies the timing signal to the system controller 160.

In addition, the display device 100 according to the present invention, as shown in FIG. 2, has a configuration such that, together with the display pixel array 110, at least the current latch circuit 140 and the reset circuit 150 are integrally formed on an insulation substrate (display panel substrate) on which a plurality of display pixels EM are formed, the pixels configuring the display pixel array 110. Further, this display device has a configuration such that the scanning driver 120 and the data driver 130 that are formed in the shape of driver chips (IC chips) are connected to each other via an external terminal (connector terminal).

Now, the above constituent elements will be specifically described here.

(Display Pixel Array)

The display pixel array 110 that can be applied to the display device according to the present embodiment, for example, as shown in FIG. 2, has a configuration such that a plurality of scanning lines SL and a plurality of data lines DL are arranged in a row direction and a column direction orthogonal to each other, and display pixels EM are connected to each cross point of the scanning lines SL and the data lines DL. The display pixels are provided with current control type light emitting elements such as organic EL elements and a pixel drive circuit that drives the light emitting elements to emit light, based on display data (gradation current).

Here, the display pixels EM arranged on the display pixel array 110 are divided into a plurality of column groups (blocks) in which a predetermined number of columns (i.e., a plurality of data lines DL) are defined as one column group. The display pixels are connected to an individual current latch circuit portion 142 described later by column group.

Specifically, for example, in the case where the display pixel array 110 has a pixel array of 144 rows×144 columns, they are divided into six column groups (columns 1 to 24, columns 25 to 48, columns 49 to 72, columns 73 to 96, columns 97 to 120, and columns 121 to 144) by 24 columns (24 data lines DL), for example. In addition, operations of capturing and holding a signal current Ic supplied from the data driver 130 are executed for each column group.

The following description will be given by applying this specific example. In addition, a specific example of circuits or circuit operations of the display pixels EM will be described later in detail.

(Scanning Driver)

The scanning driver 120 sequentially applies a scan signal Vsel of an active level (for example, high level) to scanning lines SL of each row described above, via an external terminal provided on a substrate BASE on which the display pixel array 110 is to be formed, based on a scan control signal supplied from the system controller 160. In this manner, this scanning driver controls the display pixels EM connected to the scanning lines S to be set at an active state and a gradation current Ipix to be written into the display pixels EM, the gradation current being based on display data supplied via each of the data lines DL by means of the data driver 130 and the current latch circuit 140.

Here, the scanning driver 120, as shown in FIG. 2, for example, can apply a well known configuration provided with: a shift register circuit 121 for sequentially outputting shift signals that correspond to scanning lines SL of each row, based on a scan clock signal SCK and a scan start signal SST supplied as scan control signals from the system controller 160 described later; and an output circuit (output buffer) 122 for converting the shift signals sequentially output from the shift register circuit 121 into signals having a predetermined signal level (active level or inactive level), and then, outputting the converted signals as a scan signal Vsel to the scanning lines SL of each row, based on an output control signal SOE supplied as a scan control signal from the system controller 160.

(Data Driver)

The data driver 130 sequentially repeatedly executes, by one row, operations of sequentially capturing and holding by row with a predetermined timing the display data supplied from the display signal generating circuit 170 described later, based on the data control signal supplied from the system controller 160; generating a signal current Ic having a current value responsive to a gradation value (luminance gradation signal) of the display data; dividing the generated current into a plurality of signal currents that correspond to the column groups described above; and supplying in time series the divided currents to the current latch circuit 140 (current capturing circuit portion 141 and current latch circuit portion 142 that correspond to column groups) via an external terminal provided on the substrate BASE on which the display pixel array 110 is to be formed.

Figure 3:
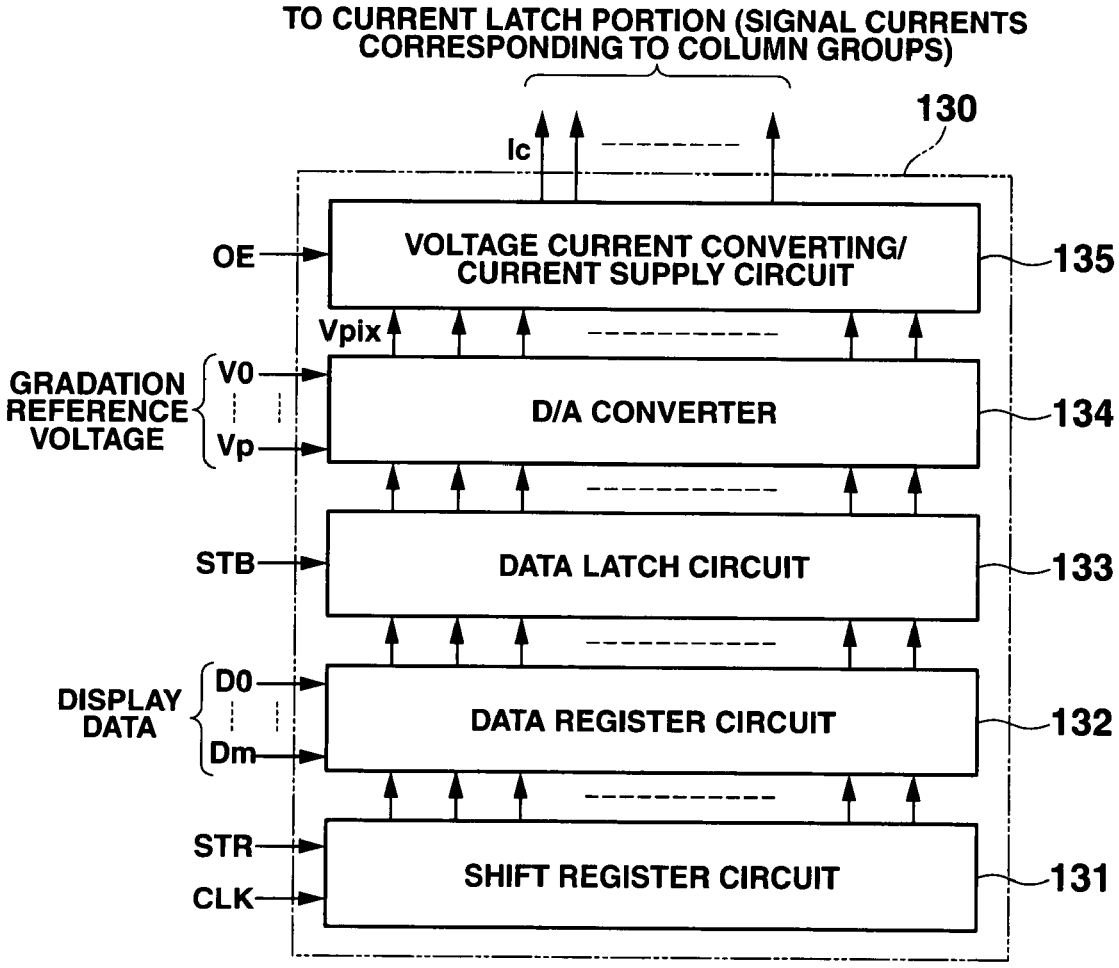
FIG. 3 is a block diagram depicting an example of a data driver that can be applied to the display device according to the present embodiment.

FIG. 3 is a block diagram depicting an example of a data driver that can be applied to the display device according to the present embodiment.

The data driver 130, as shown in FIG. 3, for example, has a configuration provided with: a shift register circuit 131; a data register circuit 132; a data latch circuit 133; a digital-analog converter circuit 134 (hereinafter, abbreviated as a "D/A converter"); a voltage-current converter/current supply circuit 135.

The shift register circuit 131 outputs a shift signal while sequentially shifting sampling start signals STR, based on a shift clock signal CLK supplied as a data control signal from the system controller 160.

The data register circuit 132 sequentially captures display data D0 to Dm (digital data) for one row supplied from the display signal generating circuit 170, based on a shift signal input timing.

The data latch circuit 133 holds display data D0 to Dm for one row captured by means of the data register circuit 132, based on a data latch signal STB.

The D/A converter 134 converts the held display data D0 to Dm into a predetermined analog signal voltage (gradation voltage Vpix), based on gradation reference voltages V0 to Vp supplied from a power supply circuit, although not shown.

The voltage-current converter/current supply circuit 135 generates a signal current Ic that corresponds to display data converted into an analog signal voltage, and then, divides the generated current into a plurality of signal currents that correspond to the column groups described above. Further, this circuit supplies the divided currents in time series to the current latch circuit 140 (current capturing circuit portion 141 and current latch circuit portion 142), based on an output enable signal OE supplied from the system controller 160.

(Current Latch Circuit)

The current latch circuit 140 repeats operations of capturing, by signal currents, a signal current Ic that is based on display data supplied from the data driver 130, based on a data control signal supplied from the system controller 160; and then, individually holding the captured signal current in response to display pixels EM connected to data lines DL of each column. This circuit holds the signal current Ic for one row; and simultaneously supplies a gradation current Ipix that corresponds to the held signal current Ic to the display pixels EM via the data lines DL with the timing when scanning lines SL of a specific row have been set at an active state by means of the scanning driver 120 described above.

The current latch circuit 140, as shown in FIG. 2, for example, is configured to have a plurality of current capturing circuit portions 141 and current latch circuit portions 142 that correspond to column groups.

The current capturing circuit 141 captures at least a signal current Ic generated and supplied by means of the data driver 130 for each signal current.

The current latch circuit portion 142 is provided with two sets of latch circuit portions by data line DL of each column. This circuit portion holds in parallel a signal current IC by column captured by means of the current capturing circuit portion 141 described above. In addition, this circuit portion generates a gradation current Ipix that corresponds to the signal current Ic by column, and then, supplies the generated current to display pixels EM via data lines DL of each column.

In the current latch circuit 140 having such a configuration, at a first timing based on a data control signal, a signal current Ic by column that corresponds to display data of display pixels EM of a specific row is captured by means of the current capturing circuit portion 141 described above; and the captured currents are held in parallel by means of the current latch circuit 142 in units of column groups. At a second timing at which display pixels EM of the row are to be set at an active state, a gradation current Ipix corresponding to the signal current Ic by column is generated, and then, the generated current is supplied simultaneously to all of the display pixels EM for one row via data lines DL. In addition, at the second timing, an operation of capturing the signal current Ic that corresponds to display data of the display pixels EM of a next row in units of column groups from the data driver 130, and then, holding the captured signal current in the current latch circuit portion 142 is executed in parallel to an operation of supplying the gradation current Ipix to all of the display pixels EM via the data lines DL.

A specific configuration and operation of the current latch circuit 140 will be described later in detail.

(Reset Circuit)

The reset circuit 150 applies a reset voltage Vrst simultaneously to the data lines DL, based on a reset control signal supplied from the system controller 160. In this manner, among the electric charges (voltage components) held in the display pixels EM or the data lines DL together with an image display operation of the display pixel array 110, the electric charges remaining after elapse of an image display period (substantially prior to operation of writing gradation current Ipix that corresponds to next display data into display pixels EM) are discharged, and a current state is set to a reset state (initialized state). In the present embodiment, as shown in FIGS. 1 and 2, for example, there has been demonstrated a configuration such that the reset circuit 150 is disposed so as to be opposed to the current latch circuit 140 while the display pixel array 110 is sandwiched therebetween. However, the reset circuit may be disposed at the same side as that of the current latch circuit 140.

A specific configuration and operation of the reset circuit 150 will be described later in detail together with the current latch circuit 140 described above.

(System Controller)

The system controller 160 controls the scanning driver 120, the data driver 130, the current latch circuit 140, and the reset circuit 150 described above to execute, with a predetermined timing, an operation of outputting a scan control signal, a data control signal, and a reset control signal for controlling an operating state, thereby generating a scan signal Vsel and applying the generated signal to scanning lines SL by means of the scanning driver 120; an operation of generating a signal current Ic and a gradation current Ipix responsive to display data by means of the data driver 130 and the current latch circuit 140, and then, applying the generated currents to data lines DL; and an operation of applying a reset voltage Vrst to the data lines DL by means of the reset circuit 150. In this manner, the system controller controls the display data generated by means of the display signal generating circuit 170 to be written into display pixels EM, a light emitting operation to be made at a proper luminance gradation, and then, predetermined image information based on a video signal to be displayed on the display pixel array 110.

(Display Signal Generating Circuit)

The display signal generating circuit 170 samples a luminance gradation signal component from a video signal supplied from the outside of the display device 100, and then, supplies the sampled component as display data to the data driver 130 by one row of the display pixel array 110. Here, in the case where the above video signal includes a timing signal component that specifies an image information display timing, like a television broadcast signal (composite video signal), the display signal generating circuit 170 has a function of sampling the timing signal component, and then, supplying the sampled component to the signal controller 160, in addition to the function of sampling the luminance gradation signal component.

In this case, the system controller 160 described above generates a variety of control signals to be supplied to the scanning driver 120, the data driver 130, the current latch circuit 140, and the reset circuit 150, based on a timing signal to be supplied from the display signal generating circuit 170.

<Specific Circuit Examples of Current Latch Circuit and Reset Circuit>

Now, a description will be given with respect to specific circuit examples of a current latch circuit and a reset circuit that can be applied to the display device according to the present embodiment.

Figure 4:
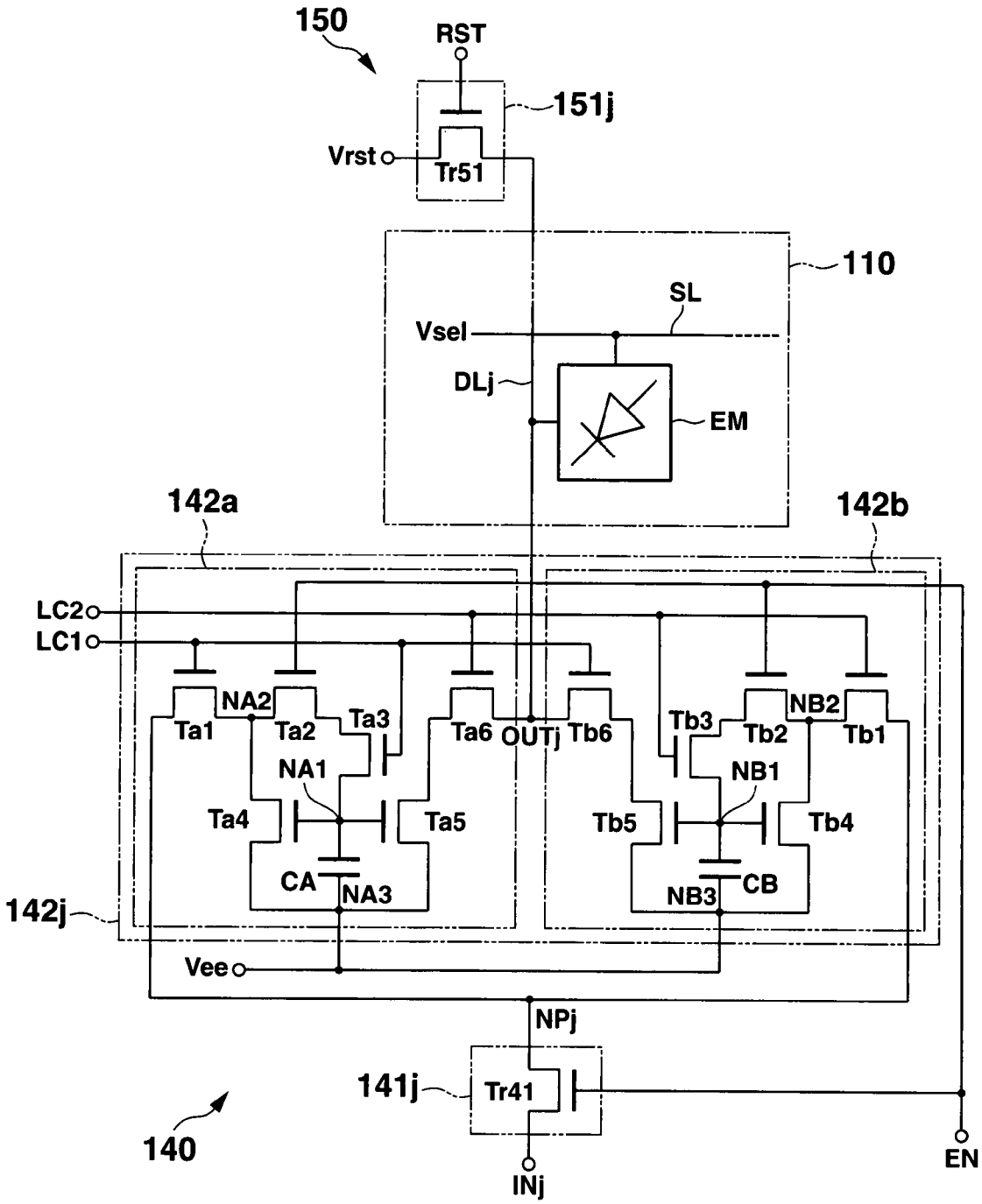
FIG. 4 is a view showing an example of a circuit configuration of a current capturing circuit portion, a current latch portion, and a reset circuit portion, each of which configures a current latch circuit and a reset circuit of the display device according to the present embodiment.

FIG. 4 is a view showing an example of a circuit configuration of a current capturing circuit portion, a current latch portion, and a reset circuit portion that configure a current latch circuit and a reset circuit of the display device according to the present embodiment.

While the figure shows a current latch portion, a current capturing portion, and a reset circuit portion that are connected to an arbitrary data line DLj (j is an arbitrary integer in the range of $1 \leqq j \leqq m$), of one column group in a plurality of data lines DL arranged in the display pixel array 110, these circuit portions are constructed similarly with respect to other data lines DL. In addition, the circuit configuration shown in FIG. 4 is merely provided as one example of a circuit configuration that can be applied to the present embodiment, without being limited thereto.

The current latch circuit 140 is made of a plurality of current capturing circuit portions 141 and current latch circuit portions 142 that correspond to each column group, and the current capturing circuit portion 141 is composed of a predetermined number of current capturing portions 141*j* that correspond to each of a predetermined number of data lines DL of a column group. In addition, the current latch circuit portions 142 each are composed of a predetermined number of current latch portions 142*j* that correspond to each of a predetermined number of data lines DL of a column group. In addition, the reset circuit 150 is composed of a plurality of reset circuit portions 151*j* that correspond to each of a plurality of data lines DL.

Each of the current capturing portions 141*j* that configure the current capturing circuit portion 141, as shown in FIG. 4, for example, has a configuration provided with: external terminals (input terminal and connector terminal) INj to which a signal current Ic is to be supplied from the data driver 130 described above; and switches Tr41 made of thin film transistors in which a current path (source-drain) is connected between the current latch portion 142*j* and a connection contact point NPj described later, and then, a current capturing signal EN supplied as a data control signal from the system controller 160 is applied to a control terminal (gate terminal). Based on the current capturing signal EN described above, a plurality of current capturing sections 141*j* (switches Tr41) provided to be associated with data lines DLj included in each column group turn ON simultaneously, and then, a current state is set to a state in which a signal current Ic supplied from the data driver 130 can be captured (capturing enable state).

Each of the current latch portions 142*j* that configure the current latch circuit portion 142 has a configuration provided with a pair (two sets) of latch circuit portions 142*a* and 142*b* that are connected in common via an output contact point OUTj to data lines DLj included in each column group and that are selectively supplied with a signal current Ic to be supplied via a connection contact point NPj from the current capturing portions 141*j* described above.

The latch circuit portion 142*a*, as shown in FIG. 4, for example, has a circuit configuration provided with: three thin film transistors Ta1 to Ta3 in which current paths each (source-drain) are connected in series between a connection contact point NPj and a contact point NA1, the connection contact point being relevant to the current capturing portions 141*j* described above; a thin film transistor Ta4 in which a current path is connected between the above contact point NA2 and a contact point N3 relevant to the thin film transistors Ta1 and Ta2; two thin transistors Ta5 and Ta6 in which current paths each are connected in series between the above contact point NA3 and an output contact point OUTj of the current latch portion 142*j*; and a capacitor CA connected between the contact points NA1 and NA3.

Here, a first latch/output switch signal LC1 to be supplied as a data control signal from the system controller is applied to control terminals of the thin film transistors Ta1 and Ta3; a current capturing signal EN to be supplied as a data control signal from the system controller is applied to a control terminal of the thin film transistor Ta2; and a second latch/output switch signal LC2 to be supplied as a data control signal from the system controller is applied to a control terminal of the thin film transistor Ta6.

Control terminals of the thin film transistors Ta4 and Ta5 are connected in common to the above contact point NA1, and the thin film transistors Ta4 and Ta5 configure a current mirror circuit.

A predetermined low electric potential voltage Vee set at a voltage level that is lower than a grounding electric potential is applied to the contact point NA3.

Like the above latch circuit portion 142*a*, the latch circuit portion 142*b* also has a circuit configuration provided with: three thin film transistors Tb1 to Tb3 in which current paths each are connected in series between a connection contact point NPj and a contact point NB1, the connection contact point being relevant to the current capturing portion 141*j*; a thin film transistor Tb4 in which a current path is connected between a connection contact point NB2 and a contact point NB3 relevant to the thin film transistors Tb1 and Tb2; two thin film transistors Tb5 and Tb6 in which current paths each are connected in series between the above contact point NB3 and an output contact point OUTj; and a capacitor CB connected between the contact points NB1 and NB3.

Here, the above second latch/output switch signal LC2 is applied to control terminals of the thin film transistors Tb1 and Tb3; the above current capturing signal EN is applied to a control terminal of the thin film transistor Tb2; and the above first latch/output switch signal LC1 is applied to a control terminal of the thin film transistor Tb6.

Control terminals of the thin film transistors Tb4 and Tb5 are connected in common to the above contact point NB1, and the thin film transistors Tb4 and Tb5 configure a current mirror circuit. In addition, a low electric potential voltage Vee is applied to the contact point NB3, like the above contact point NA3.

In the current latch portion 142*j* having such a circuit configuration, the thin film transistors Ta4 and Tb 4 (first transistors) and capacitors CA and CB (electric charge accumulating circuits) provided in the latch circuit portions 142*a* and 142*b* configure a current holding portion according to the present invention, and the capacitors CA and CB and the thin film transistors Ta5 and Tb5 (second transistors) configure a current output portion according to the present invention.

The thin film transistors Ta4 and Ta5 configuring a current mirror circuit provided in each of the latch circuit portions 142*a* and 142*b* or a current of each of the thin film transistors Tb4 and Tb5 are set at 1:1 or 1:x (x>1), for example. Here, the capacitors CA and CB provided in the latch circuit portions 142*a* and 142*b* each may be individually provided capacitors or may be parasitic capacitors formed between a gate and a drain of the thin film transistor Ta4 or Ta5 or the thin film transistor Tb4 or Tb5.

Each of the reset circuit portions 151*j* configuring the reset circuit 150, as shown in FIG. 4, for example, has a configuration provided with switches Tr51 made of thin film transistors in which a reset control signal RST supplied from the system controller 160 is applied to a control terminal (gate terminal), thereby applying a predetermined reset voltage Vrst to data lines DLj. Here, the reset voltage Vrst is set at a voltage value that can be set at a reset state (initialized state) while discharging the electric charge that remains in the display pixels EM or data lines DL prior to an operation of writing into each of the display pixels EM a gradation current Ipix that corresponds to display data, from the data driver 130 and the current latch circuit 140 described above.

In the present embodiment, for example, n-channel type electric field effect type transistors using amorphous silicon semiconductors or polysilicon semiconductors as channel layers can be applied as switches Tr41 provided in each of the current capturing portions 141*j*; thin film transistors Ta1 to Ta6 and Tb1 to Tb6 provided in each of the current latch portions 142*j* (latch circuit portions 142*a* and 142*b*); and switches Tr51 provided in each of the reset circuit portions 151*j*.

In addition, at the outer periphery of the substrate BASE on which there are formed the current latch circuit 140 and the reset circuit 150 described above and the display pixel array 110 having arranged therein in a two-dimensional manner the display pixels EM provided with a pixel drive circuit described later, a protective element ring mechanism may be applied, the ring mechanism being connected to a grounding electric potential while a wiring layer is formed so as to surround these constituent elements. In this manner, a malfunction exerted by a variety of noises invading from the outside of the substrate BASE is restrained, making it possible to properly achieve an image display operation described later.

Now, with reference to the accompanying drawings, a description will be given with respect to operations in the current latch circuit and the reset circuit each having the circuit configuration described above.

(Operation of Current Latch Circuit)

Figure 5:
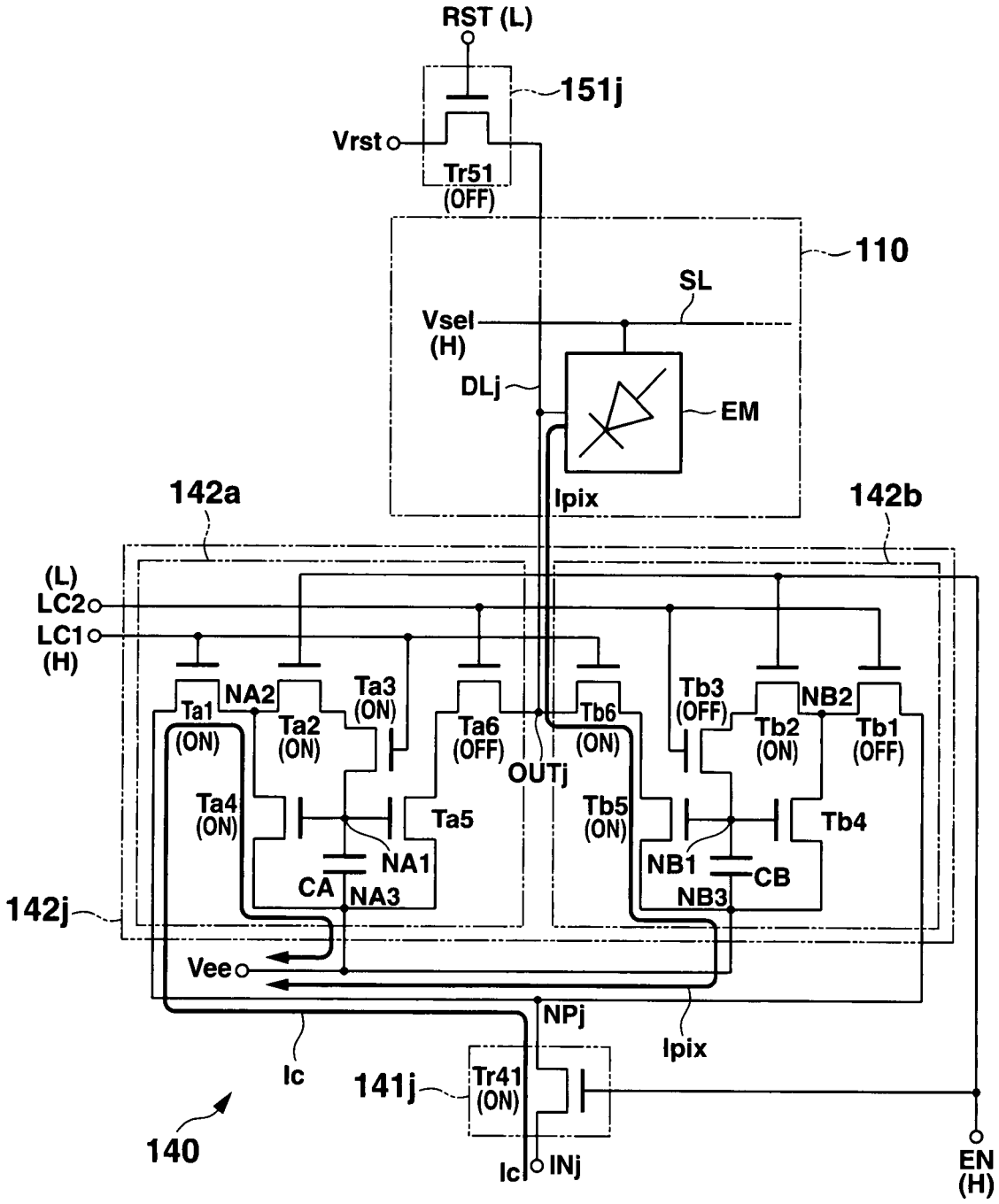
FIGS. 5 and 6 are conceptual views each showing an operating state in the current latch portion that can be applied to the present embodiment.
Figure 6:
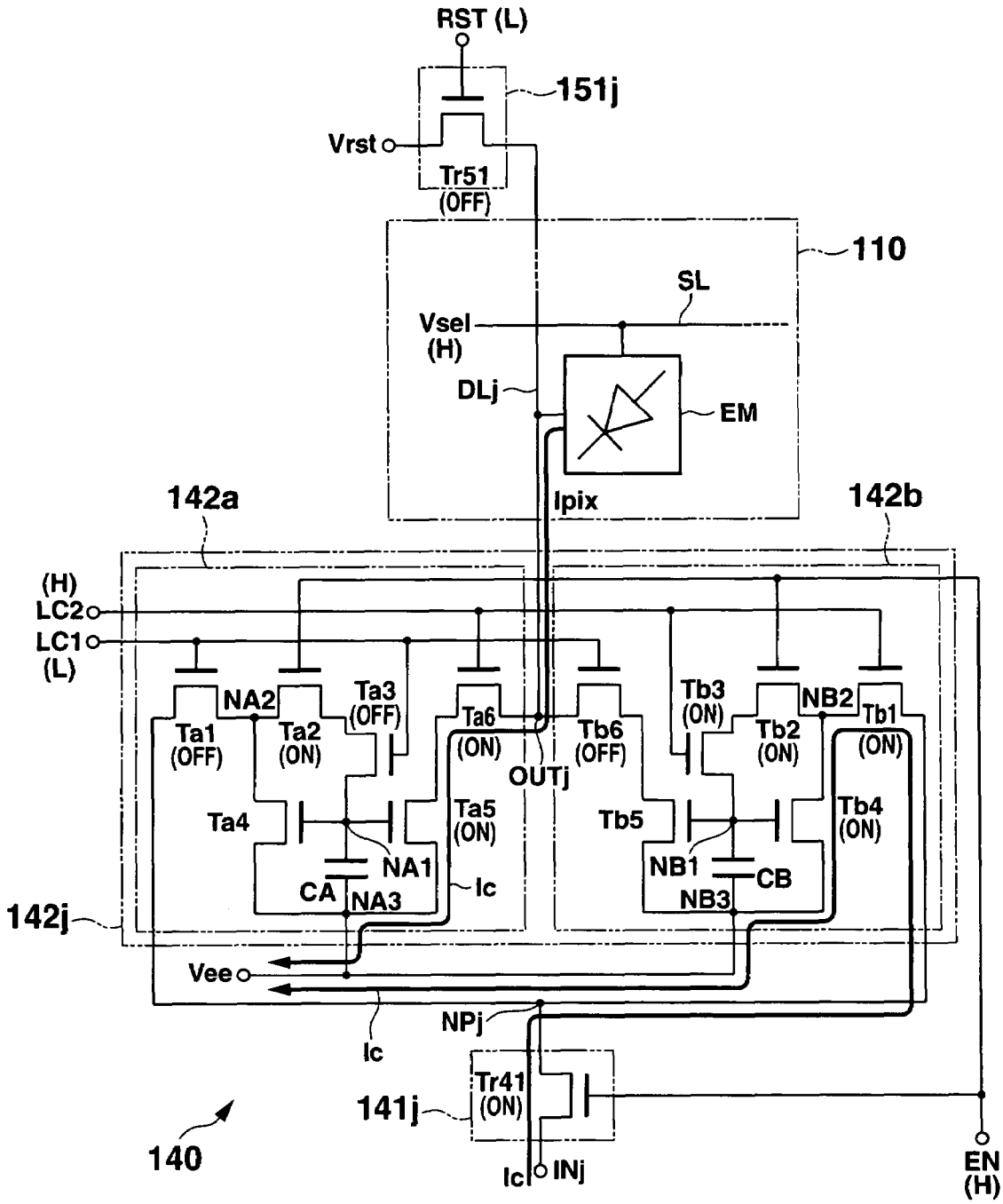

FIGS. 5 and 6 are conceptual views each showing an operating state in a current latch portion that can be applied to the present embodiment.

Now, a description will be given here with respect to operations in a current capturing portion 141*j* and a current latch portion 142*j* that correspond to one arbitrary data line DLj in one column group, shown in FIG. 4. A similar operation is synchronously executed in a current capturing portion 141*k* and a current latch portion 142*k* that correspond to another data line DLk (k≠j) in the same column group.

Operations in a current latch circuit 140 (current capturing portion 141*j*, current latch portion 142*j*) according to the present embodiment include: a current latch operation of, among signal currents Ic based on display data that corresponds to display pixels EM for one row supplied from the data driver 130 in time series, capturing the signal current Ic of the signal currents that correspond to one column group in either one of latch circuit portions 142*a* and 142*b* that configure the current latch portion 142*j* via the current capturing portion 141*j*, converting the captured signal current into a voltage component, and then, holding the converted voltage component; and a current output operation of generating, from the other one of the latch circuit portions 142*a* and 142*b* that configure the current latch portion 142*j*, a gradation current Ipix based on the voltage component (signal current Ic) held by means of the immediately preceding current latch operation, and then, simultaneously supplying the generated gradation current to data lines DLj via an output contact point OUTj.

In addition, the current latch operations described above are sequentially executed in the current latch circuit portions 142 that correspond to column groups of the display pixel array 110 so as to maintain the signal currents Ic that correspond to display pixels EM for one row, and then, simultaneously supply to data lines DLj the gradation current Ipix that is based on the signal currents Ic for one row held in the current latch circuit portions 142 at an immediately preceding capturing timing. Then, the current latch operation and current output operation described above are controlled so that they are alternately executed in synchronism with each other between the latch circuit portions 142*a* and 142*b* that configure the current latch portion 142*j*.

In other words, in a period in which the signal current Ic supplied in association with data lines DLj included in column groups from the data driver 130 based on display data is captured and held in one of the latch circuit portions (for example, latch circuit portion 142*a*) that configure each current latch portion 142*j*, the gradation currents Ipix that are based on the signal currents Ic captured and held at an immediately preceding capture timing from the other latch circuit portion (for example, latch circuit portion 142*b*) simultaneously in parallel are simultaneously supplied to data lines DLj. In this manner, an operation of supplying the gradation current Ipix to data lines DLj of each column while substantially continuously capturing the signal current Ic that is based on display data is executed.

Hereinafter, each of the operations described above will be specifically described with reference to each of the circuit configurations of the current latch portions described above.

First, as shown in FIG. 5, in the current capturing portion 141*j* described above, a current capturing signal EN supplied as a data control signal from the system controller 160 is set at a high level (H) at a timing that is different depending on each column group, whereby switches Tr41 turn ON in units of column groups.

In addition, in the current latch portion 142*j* described above, a first latch/output switch signal LC1 supplied as a data control signal from the system controller 160 is set at a high level (H), and a second latch/output switch signal LC2 is set at a low level (L), whereby the thin film transistors Ta1 to Ta3 of the latch circuit portion 142*a* turn ON, and then, the thin film transistor Ta6 turns OFF.

Then, in synchronism with this timing, when a signal current corresponding to each of the display pixels EM is supplied from the data driver 130 via an individual external terminal (input terminal) INj that corresponds to each column of a column group, a gate-drain of the thin film transistor Ta4 is electrically short-circuited, and thus, ON operation is made in a saturation area. Then, the signal current Ic flows to a low electric potential voltage Vee side via the current capturing portions 141*j* (switches Tr41), thin film transistors Ta1 and Ta4 of the latch circuit portion 142*a*, and a contact point NA3; a current level of the signal current Ic is converted into a voltage level (voltage component) of the gate-source of the thin film transistor Ta4; and a current latch operation of accumulating an electric charge in an accumulator capacitor CA is made.

At this time, an electric potential of a contact point NA1 increases concurrently with accumulation of the electric charge into the accumulator capacitor CA. As a result, a thin film transistor Ta5 that configures a current mirror circuit together with the thin film transistor Ta4 turns ON. However, the thin film transistor Ta6 is set at an OFF state, and thus, no current flows in the thin film transistor Ta5.

Next, as shown in FIG. 6, in the current latch portion 142, the first latch/output switch signal LC1 supplied as a data control signal from the system controller 160 is set at a low level (L), and the second latch/output switch signal LC2 is set at a high level (H), whereby the thin film transistors Ta1 and Ta3 of the latch circuit portion 142*a* turns OFF, and then, the thin film transistors Ta2 and Ta6 turn ON.

At this time, an electric potential (high voltage) based on an electric charge accumulated by the accumulator capacitor CA by means of the current latch operation (FIG. 5) described above is held in the contact point NA1, and thus, the thin film transistor Ta5 continues ON operation. In this manner, a current output operation is made such that the data lines DLj are connected to the low electric potential voltage Vee via the output contact point OUTj of the latch circuit portion 142*a* and the thin film transistors Ta6 and Ta5, and then, the gradation current Ipix having a current value based on the electric charge (i.e., signal current Ic) accumulated by the accumulator capacitor CA flows, as if it were drawn, in the direction of the latch circuit portion 142*a* (current latch circuit portion 142) from the data lines DLj.

In the current latch operation (FIG. 5) of the latch circuit portion 142*a* described above, the first latch/output switch signal LC1 supplied as a data control signal from the system controller 160 is set at a high level (H), and then, the second latch/output switch signal LC2 is set at a low level (L), whereby thin film transistors Tb1 and Tb3 of the latch circuit portion 142*b* turn OFF, and then, the thin film transistors Tb2 and Tb6 turn ON.

At this time, in the case where an electric potential (high voltage) is held in the contact point NA1, the electric potential being based on an electric charge accumulated by an accumulator capacitor CB at a timing preceding the current latch operation of the latch circuit portion 142*a* described above, the thin film transistor Tb5 turns ON, whereby the data lines DLj are connected to the low electric potential voltage Vee via the output contact point OUTj of the latch circuit portion 142*b* and the thin film transistors Tb6 and Tb5. Thus, a current output operation is made such that the gradation current Ipix having a current value based on the electric charge (i.e., signal current Ic) accumulated by the accumulator capacitor CB flows as if it were drain, from the data line DLj side to the direction of the latch circuit portion 142*b* (current latch circuit portion 142).

In addition, in the current output operation (FIG. 6) of the latch circuit portion 142*a* described above, the first latch/output switch signal LC1 supplied as a data control signal from the system controller 160 is set at a low level (L), and then, the second latch/output switch signal LC2 is set at a high level (H), whereby the thin film transistors Tb1 to Tb3 of the latch circuit portion 142*b* turn ON, and then, the thin film transistor Tb6 turns OFF.

Then, in synchronism with this timing, when a signal current Ic corresponding to each of display pixels EM is supplied from the data driver 130 via an individual external terminal (input terminal) INj that corresponds to each of columns of a column group, the thin film transistor Tb4 turns ON in a saturation area. Then, a current latch operation is made such that the signal currents Ic flow to the low electric potential voltage Vee side via the current capturing portions 141*j* (switches Tr41), the thin film transistors Tb1 and Tb4 of the latch circuit portion 142*b*, and a contact point NB3; a current level of the signal current Ic is converted into a gate-source voltage level (voltage component) of the transistor Tb4 and accumulated as an electric charge by the accumulator capacitor CB.

In other words, in a period in which either of the latch circuit portions 142*a* and 142*b* has been set at a current latch operation state, the other side is set at a current output operation state simultaneously in parallel.

While a description has been given with respect to a case in which, in the current latch circuit 140 according to the present embodiment, there is provided a function of generating a negative gradation current Ipix that corresponds to a signal current Ic with positive polarity supplied from the data driver 130 in order to cope with a circuit configuration of a pixel drive circuit provided in display pixels EM described later (reference should be made to FIG. 12), and the gradation current Ipix is drawn (pulled out) from the data line DLj (display pixel EM), the present invention is not limited thereto. A configuration may be provided such that a gradation current Ipix with positive polarity is generated in accordance with the circuit configuration of display pixels EM, and then, the gradation current Ipix is fed in the direction of data lines DLj (display pixels EM).

Most of well known data drivers that are generally distributed and commercially available have a configuration of outputting a current with positive polarity (signal current Ic). Thus, by applying the current latch circuit 140 having the configuration as described above, the gradation current can be fed in a direction in which the current is drawn in the direction of the current latch portion with the use of the well known data driver.

(Operation of Reset Circuit)

Figure 7:
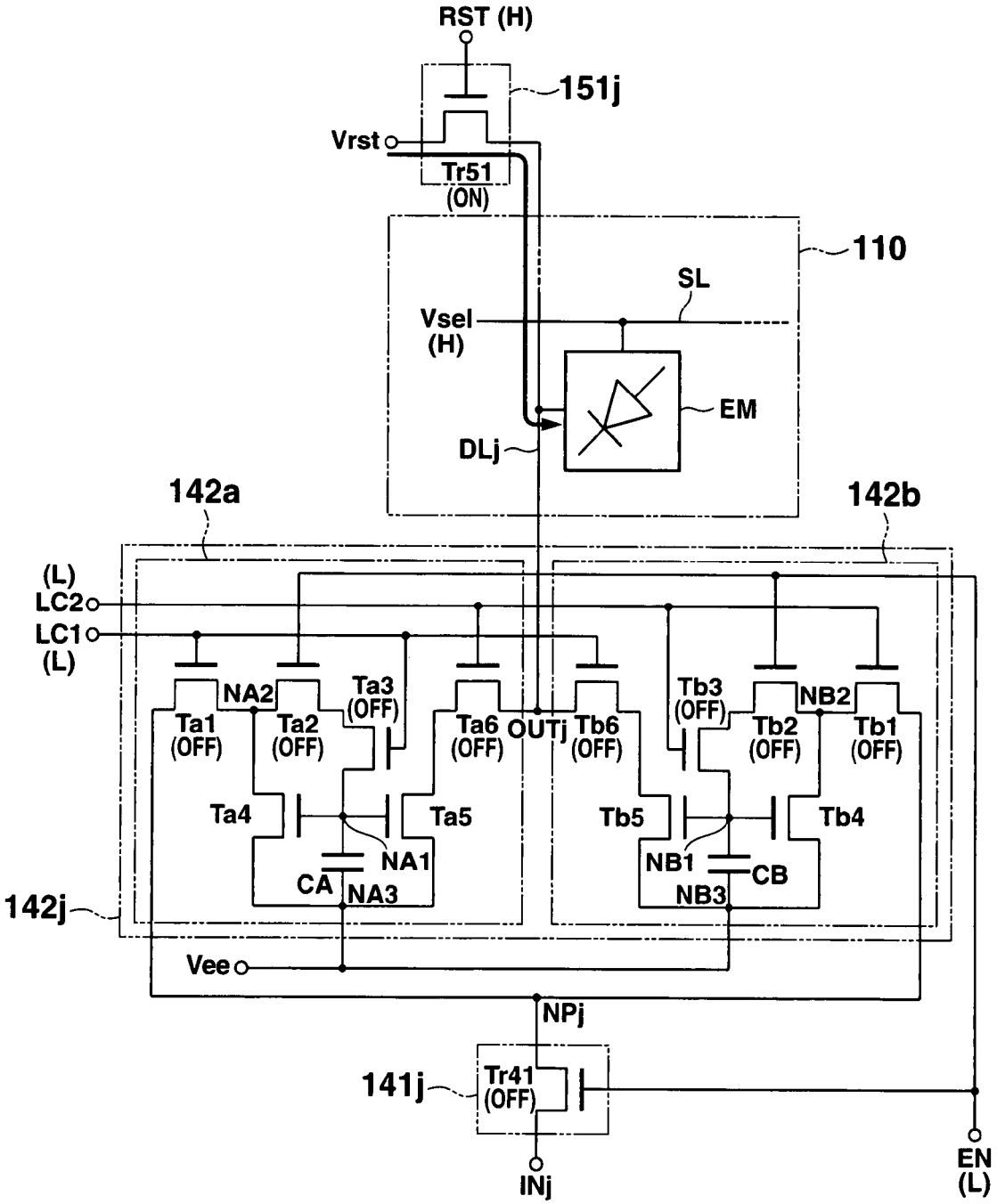
FIG. 7 is a conceptual view showing an operating state in a reset circuit that can be applied to the present embodiment.

FIG. 7 is a conceptual view showing an operating state in a reset circuit that can be applied to the present embodiment.

Now, a description will be given here with respect to an operation of a reset circuit portion 151*j* that corresponds to one arbitrary data line DLj in a plurality of data lines DL arranged in the display pixel array 110, shown in FIG. 4. A similar operation is synchronously executed in reset circuits 150 provided to data lines DL (all columns) as well.

In the operation of the reset circuit 150 according to the present embodiment, as shown in FIG. 7, a reset control signal RST supplied from the system controller 160 is set at a high level (H) with a predetermined timing in the reset circuit portion 151*j* described above, whereby switches Tr51 provided in data lines DL of each column turn ON.

In addition, at this time, all of the current capturing signals EN supplied as a data control signal from the system controller 160 by column group are set at a low level (L) and the first latch/output switch signal LC1 and the second latch/output switch signal LC2 are both set at low level (L), whereby the switches Tr41 in the data lines DL of all columns turn OFF and the thin film transistors Ta1 to Ta3 and Ta6 of the latch circuit portion 142*a* and the thin film transistors Tb1 to Tb3 and Tb6 of the latch circuit portion 142*b* turn OFF.

In this manner, a predetermined reset voltage Vrst is applied to data lines DL of all columns via the switches Tr51. In synchronism with this timing, a reset operation is made such that a scan signal Vsel of an active level (high level: H) is applied from the scanning driver 120 to scanning lines SL of a specific row, whereby the reset voltage Vrst described above is applied to display pixels EM of the row; the electric charge (voltage component) remaining in the display pixels EM and the electric charge accumulated by a wiring capacity of each of the data lines DL are discharged, and then, a current state is set at a reset state.

(Whole Configuration of Current Latch Circuit)

Figure 8:
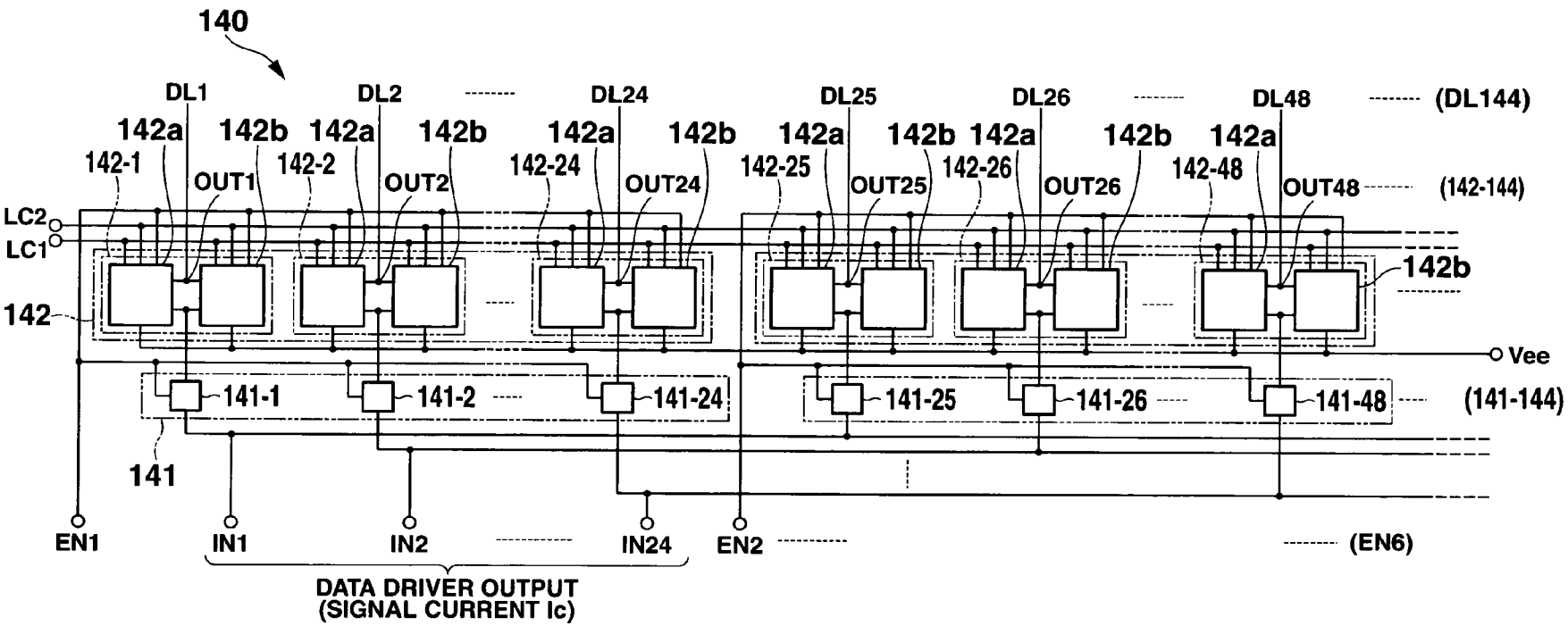
FIG. 8 is a schematic view showing an example of a current latch circuit in the case of applying the current capturing circuit portion and the current latch circuit portion according to the present embodiment.

FIG. 8 is a schematic diagram showing an example of a current latch circuit in the case where a current capturing circuit portion and a current latch circuit portion according to the present embodiment have been applied.

Here, a description will be given with reference to the current configuration of the current capturing circuit portion and the current latch portion shown in FIG. 4 and the operations shown in FIGS. 5 and 6.

As in the specific examples described above, in the case where the display pixel array 110 has a pixel arrangement of 144 rows×144 columns, a current latch circuit 140, as shown in FIG. 8, is composed of: a current capturing circuit portion 141 and a current latch circuit portion 142 provided in association with each of six column groups (columns 1 to 24, columns 25 to 48, . . . columns 121 to 144) while 24 columns (24 data lines DL) are defined as one column group.

Each current capturing circuit portion 141 is composed of: current capturing portions 141-1 to 141-24; current capturing portions 141-25 to 141-48; . . . current capturing portions 141-121 to 141-144 that correspond to data lines DL. Each current latch circuit portion 142 is composed of: current latch portions 142-1 to 142-24; current latch portions 142-25 to 142-48, . . . current latch portions 142-121 to 142-144 that correspond to data lines DL.

The current capturing portions 141-1, 141-25, 141-121 that correspond to a first column of each column group are connected in common to an external terminal (input terminal) IN1. The current capturing portions 141-2, 141-26, . . . 141-122 that correspond to a second column of each column group are connected in common to an external terminal (input terminal) IN2. Similarly, the current capturing circuit portion 141-24, 141-48, . . . 141-144 that correspond to a 24th column of each column group are connected in common to an external terminal (input terminal) IN24.

In addition, current latch portions 142*j* of the current latch circuit portion 142 corresponding to each column group are connected to data lines DL (DL1 to DL24, DL25 to DL48, . . . DL121 to DL144) of each column arranged in the display pixel array 110, and have output contact points OUTn (OUT1 to OUT24, OUT25 to OUT48, . . . OUT121 to OUT144) are provided for individually supplying a gradation current Ipix responsive to display data (signal current Ic).

In this manner, with respect to the current capturing circuit portions 141 of each column group, current capturing control signals EN1, EN2, . . . EN6 are individually supplied from the system controller 160 with the timing that are different depending on each column group, whereby the column groups are sequentially set at a current capturing operation state. Thus, operations of simultaneously capturing signal currents Ic (signal currents) for 24 pixels supplied from the data driver 130 via 24 external terminals IN1 to IN24 are sequentially executed by current capturing circuit portion 141, and then, the signal currents Ic corresponding to display pixels EM for one row are captured.

In addition, the current latch circuit portions 142 of each column group execute: a current latch operation (FIG. 5) of converting the signal current Ic captured via the above current capturing circuit portion 141 into a voltage component, and then, holding the converted voltage component by means of the above current capturing control signals EN1, EN2, . . . EN6 individually supplied from the system controller 160 with the timing that is different depending on each column group and by means of the first latch/output switch signal LC1 and the second latch/output switch signal LC2 supplied in common to all of the column groups; and a current output operation (FIG. 6) of drawing a gradation current Ipix responsive to the held voltage component (signal current Ic).

<Method for Driving Display Device>

Now, a method for driving the display device that has the configuration described above will be described with reference to the accompanying drawings.

Figure 9:
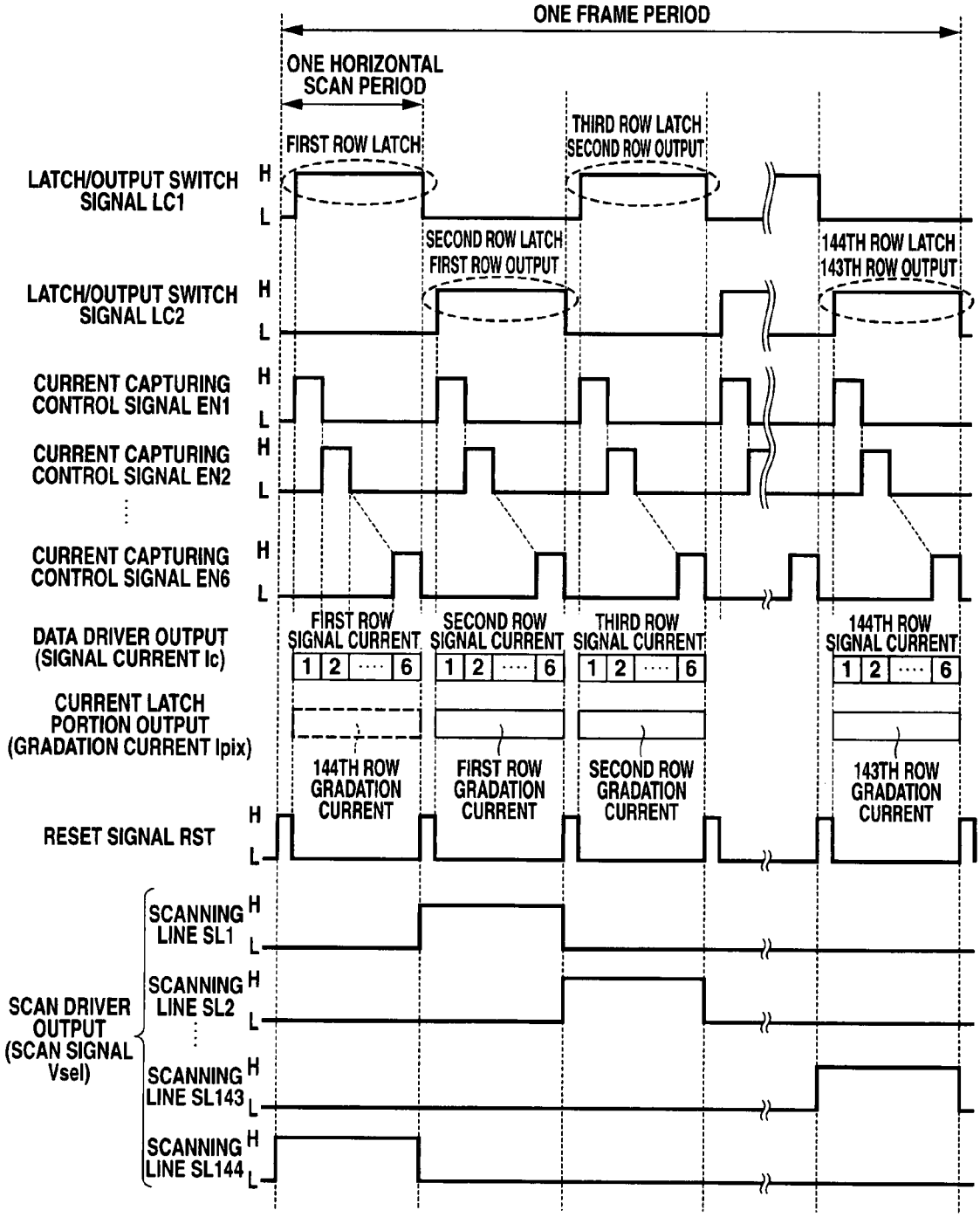
FIG. 9 is a timing chart showing an example of a method for driving the display device according to the present embodiment.

FIG. 9 is a timing chart showing an example of a method for driving the display device according to the present embodiment.

Here, as in the specific example described above, a case in which the display pixel array 110 has a pixel arrangement of 144 rows×144 columns will be described with appropriate reference to the configurations of the display device 100 described above and operations of the current latch circuit 140 and the reset circuit 150.

A drive control operation of the display device 100 having the configuration described above roughly includes a current latch operation period, a reset operation period, and a current write operation period while two horizontal scanning periods are defined as one unit period.

In the current latch operation period, an operation is carried out for sequentially capturing the signal currents Ic responsive to display data for one row supplied from the data driver 130 in a first-half one horizontal scanning period by signal currents of a column group unit, and then, holding in the current latch circuit 140 an electric charge (voltage component) responsive to display data (signal current Ic) for one row.

In the reset operation period, at the beginning of a last-half one horizontal scanning period, an operation is carried out for discharging and initializing the electric charges that remain in data lines DL arranged in the display pixel array 110 and in display pixels EM of a row targeted for a current write operation described later.

In the current write operation period, after the end of the reset operation in the last-half one horizontal scanning period, an operation is carried out for simultaneously writing the gradation current Ipix responsive to the electric charge held in the current latch circuit 140 in the current latch operation described above and causing a light emitting element to emit light. This operation is equivalent to the current output operation in the current latch circuit 140 described above.

In the case where the display pixel array 110 having the pixel arrangement of 144 rows×144 columns is driven at a frame frequency of 30 Hz, the above one horizontal scanning period is specified to be 231.48 μsec.

First, in the current latch operation, as shown in FIG. 9 (reference should be made to "first row latching" in the figure), the first latch/output switch signal LC1 supplied as a data control signal from the system controller 160 is set at a high level (H) and the second latch/output switch signal LC2 is set at a low level (L). In the current latch operation period, current capturing control signals EN1 to EN6 are sequentially set at a high level with the timing in which these control signals do not overlap each other temporally. In this manner, as shown in FIG. 5, operations are sequentially executed in the current capturing circuit portion 141 and the current latch circuit portion 142 in each column group, such that the signal currents Ic for 24 pixels output by column groups from the data driver 130 are supplied to the current capturing circuit portions 141 (current capturing circuits of any column group of 141-1 to 141-24 or 141-25 to 141-48, . . . 141-121 to 141-144) of column groups with different timings via external terminals IN1 to IN24 provided independently, and then, captured by one latch circuit portion 142*a* provided in the current latch circuit portion 142 of the column group (current latch circuit of any current group of 142-1 to 142-24 or 142-25 to 142-48, . . . 142-121 to 142-144) and held as electric charge (voltage component). Then, the signal currents for one row (of a first row) is captured and held in the current latch circuit 140 (In FIG. 9, data driver outputs are expressed as "1" to "6").

Then, in the reset operation, as shown in FIG. 9, after the end of the above current latch operation, the first latch/output switch signal LC1, the second latch/output switch signal LC2, and the current capturing control signals EN1 to EN6 are set at a low level (L). The data control signal RST supplied from the system controller 160 is set at a high level (H). In addition, the scan signal Vsel applied from the scanning driver 120 to the scanning line SL of a row (first row) targeted for a current write operation described later is set at a high level (H). In this manner, as shown in FIG. 7, the predetermined reset voltages Vrst are applied simultaneously via the reset circuit portions 151*j* and data lines DL provided by lines to display pixels EM (pixel drive circuit) set at an active state. Then, the electric charges (voltage components) that remain in display pixels EM of the row (first line) and the electric charges charged in the wiring capacity of data lines DL of each column are discharged (initialized).

In the current latch operation described above, a required minimum time is approximately on the order of 10 μsec, which is required for capturing the signal current Ic supplied from the data driver 130 by column groups, and then, holding the captured signal current in the current latch circuit portion 142 (latch circuit portion 142*a* or 142*b*). In addition, a required minimum time, required in the reset operation executed for all of the column groups at the same time, is approximately on the order of 15 μsec. Here, as shown in FIG. 9, in the case where the display pixel array 110 having the pixel arrangement of 144 rows×144 columns is driven at a frame frequency of 30 Hz, the current latch operation period in each column group is set at 35.2 μsec (35.2×6=211. 2 μsec in all of the column groups), and the reset operation period is set at 20.28 μsec (35.2×6+20.28 =231.48 (one horizontal scanning period)). In other words, a maximum number of column groups set at the display pixel array 110 (maximum number of divisions) is specified in accordance with a required time set for the current latch operation period.

Next, in the current write operation (current output operation), as shown in FIG. 9 (reference should be made to "first row output" in the figure), the first latch/output switch signal LC1 is set at a low level (L), and the second latch/output switch signal LC2 is set at a high level (H). During the current write operation period, the scan signal Vsel applied from the scanning driver 120 to the scanning lines SL of a row (first row) targeted for the current write operation is set at a high level (H). In this manner, as shown in FIG. 6, the gradation currents Ipix with negative polarity based on the electric charge held in one latch circuit portion 142*a* provided in the current latch circuit 140 (current latch circuit portion 142) are supplied to data lines DL of each column. Then, the supplied gradation currents Ipix flow simultaneously as if they are drawn from display pixels EM (pixel drive circuit) set at an active state to the direction of the current latch circuit 140 via data lines DL of each column. In this manner, as described later, electric charges (voltage components) responsive to the gradation currents Ipix are held in the pixel drive circuit provided in the display pixel EM (of first row), and display data (gradation currents Ipix) are written.

Then, in synchronism with the current write operation period for outputting the gradation current Ipix from one latch circuit portion 142*a* provided in such a current latch circuit portion 142, as shown in FIG. 9 (reference should be made to "second row latch" in the figure), the first latch/output switch signal LC1 is set at a low level (L) and the second latch/output switch signal LC2 is set at a high level (H). Thus, in the current write operation period, the current capturing control signals EN1 to EN6 are sequentially set at a high level (H) with the timing at which these control signals do not overlap each other temporally. In this manner, as in the current latch operation of the first row described above, a current latch operation is executed such that the signal currents Ic for 24 pixels output by column groups from the data driver 130 are sequentially captured by the other latch circuit portion 142*b* provided to the current latch circuit 140 (current capturing circuit portion 141 and current latch circuit portion 142 of each column group) with the different timings via the external terminals IN1 to IN24, and then, the signal current Ic for one row (of a second row) is held as an electric charge (voltage component).

Therefore, in the present embodiment, operations are sequentially repeated for dividing a plurality of display pixels arranged in a two-dimensional manner in the display pixel array into column groups (blocks) by a plurality of columns; providing external terminals, the number of which corresponds to display pixels of the number of columns included in each column group; and, with a first timing, capturing and holding a signal current that corresponds to the display data in units of column group, thereby converting the signal current responsive to display pixels for one row to voltage components and holding them. Then, with a second timing, based on the voltage component held with the first timing, the gradation current responsive to the above display data is generated by display pixels for one row, so that the above gradation currents can be simultaneously written into the display pixels of a specific row via the data lines arranged in the display pixel array. Therefore, in a configuration in which a data driver formed as a driver chip and a substrate (display panel substrate) having the display pixel array formed thereon are connected to each other via external terminals for the number of columns included in the column-groups, the gradation current responsive to display data can be properly written into the display pixels of the display pixel array.

Specifically, in the case where the display pixel array 110 having the pixel arrangement of 144 rows×144 columns described above is applied, and then, the pixels are divided into six column groups, in the display device according to the present embodiment, the number of external terminals for connecting the substrate (display panel substrate) and the data driver is obtained as 144 (columns)/6 (groups)=24 (columns). Thus, in comparison with a case in which the data lines on the substrate and the output terminals of the data driver are connected to each other in a relationship of 1:1 as in the conventional technique, a configuration can be provided such that they are connected to each other via external terminals, the number of which is 1/the number of column groups (in other words, in the case where the number of column groups is defined as "k", 1/k of the conventional technique).

In this manner, even in the case where the display pixel array (display panel has high resolution, an increasing number of output terminals of the data driver (driver chip) can be restrained or the number of output terminals can be reduced. In addition, the narrowing of inter-terminal pitches (gaps) can be restrained, thus making it possible to simplify positional precision or to reduce man hours in a process for connecting the driver chip. Further, a current latch portion and a reset circuit portion can be integrally formed on a substrate having a display pixel array formed thereon, thus making it possible to restrain an increasing number of parts and restrain product costs of a display device.

Another Embodiment

Another embodiment of a display device according to the present invention will be described with reference to the accompanying drawings.

Figure 10:
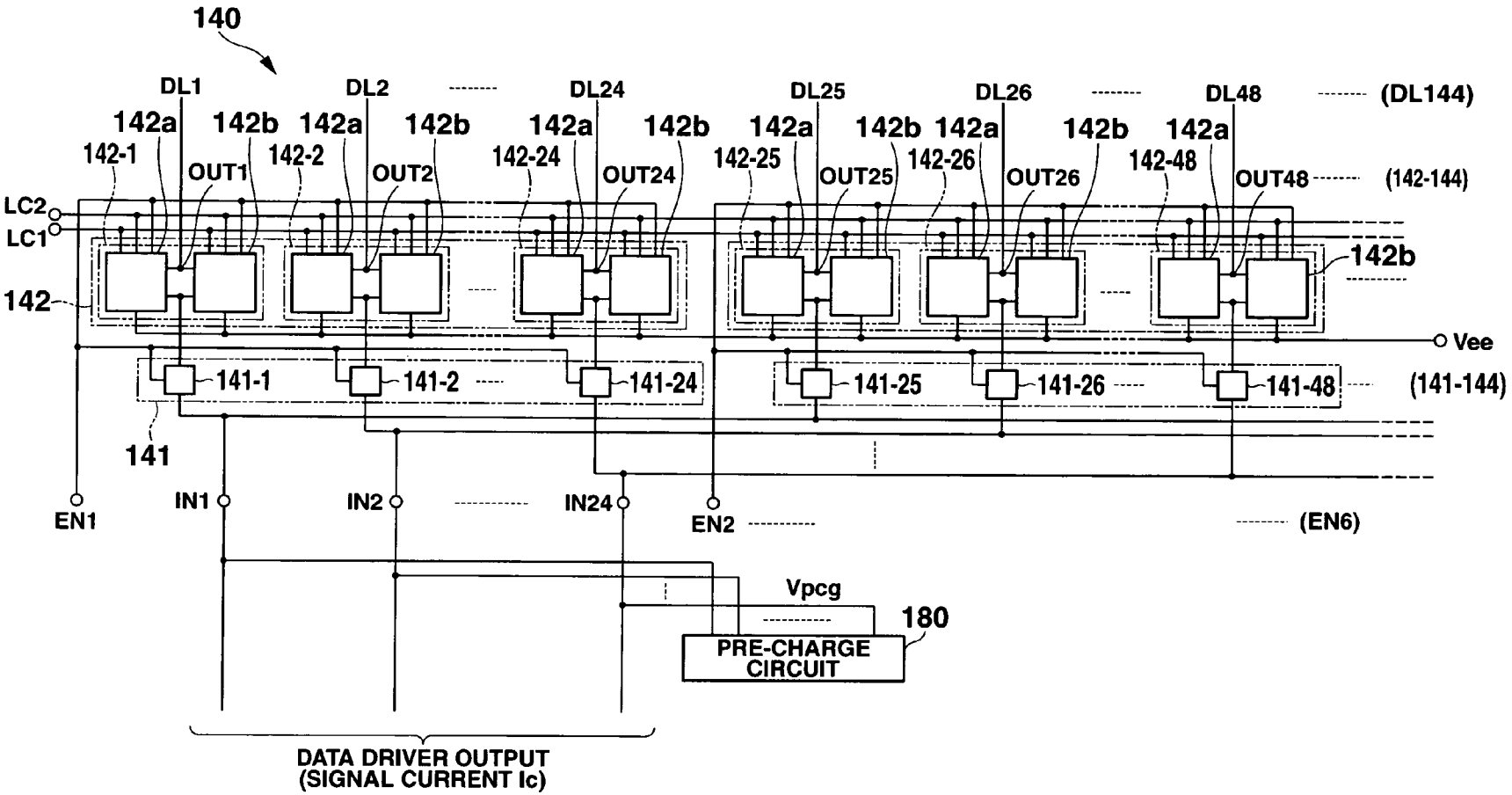
FIG. 10 is a schematic view showing another example of a current latch portion in another embodiment of the display device according to the present invention.

FIG. 10 is a schematic view showing another example of a current latch portion in another embodiment of the display device according to the present invention.

Figure 11:
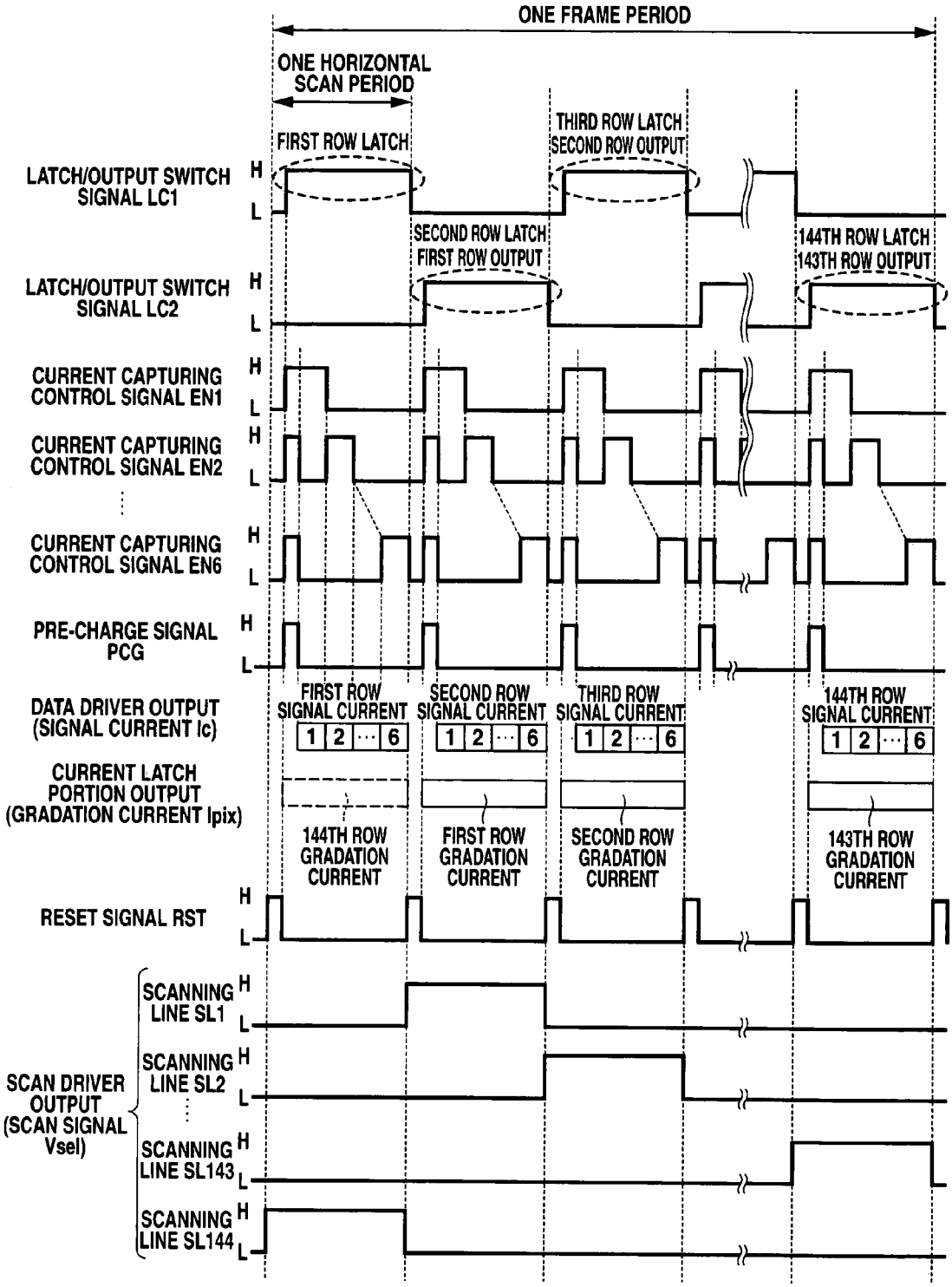
FIG. 11 is a timing chart showing an example of a method for driving the display device according to the present invention.

FIG. 11 is a timing chart showing an example of a method for driving the display device according to the present embodiment.

Here, like configuration and operation of the embodiment described above (reference should be made to FIGS. 8 and 9) are briefly described here.

In addition to the configuration in the embodiment described above (reference should be made to FIG. 8), a current latch circuit 140 applied to the display device according to the present embodiment, as shown in FIG. 10, has a configuration in which a pre-charge circuit 180 is connected, the pre-charge circuit applying a predetermined pre-charge voltage Vpcg to external terminals (input terminals) IN1 to IN24 to which signal currents are supplied from a data driver 130.

Here, the pre-charge voltage Vpcg is applied with the timing prior to a latch operation of a signal current Ic in the current latch circuit 140 (a pair of latch circuit portions 142*a* or 142*b* provided in current latch circuit portion 142). In addition, based on applying of the pre-charge voltage Vpcg, the voltage component held in the current latch circuit portion 142 is set on the order of a threshold value voltage of transistors that configures a current mirror circuit of the latch circuit portion 142*a* or 142*b*, or alternatively, at a voltage value in the vicinity of such threshold value voltage.

While FIG. 10 shows that the pre-charge circuit 180 has a configuration independent of the data driver 130, and is connected to the external terminals (input terminals) IN1 to IN24, the present invention is not limited thereto. The data driver 130 may incorporate a function of generating and outputting a pre-charge voltage.

In a drive control operation of a display device 100 having such a configuration, as shown in FIG. 11, with the timing prior to the current latch operation described above, a first latch/output switch signal LC1 supplied as a data control signal from a system controller 160 is set at a high level (H) and a second latch/output switch signal LC2 is set at a low level (L). In addition, all of current capturing control signals EN1 to EN6 are set at a high level (H) at the same time and a pre-charge signal PCG supplied from the system controller 160 is set at a high level. In this manner, a predetermined pre-charge voltage Vpcg applied from the pre-charge circuit 180 to each of the external terminals IN1 to IN24 is applied in common to one latch circuit portion 142*a* (or 142*b*) provided in current latch portions 142-1 to 142-144 of current latch circuit portions 142 via current capturing portions 141-1 to 141-144 of a current capturing circuit portion 141 of each column group. In addition, a voltage component responsive to the pre-charge voltage Vpcg is charged in a capacitor CA (or CB).

Here, as described above, with respect to a voltage component to be charged in the latch circuit portion 142*a* (capacitor CA) by means of this pre-charge operation, a voltage value of the above pre-charge voltage Vpcg is set on the order of a threshold value voltage in each of thin film transistor Ta4 and Ta5 that configure a current mirror circuit or in the vicinity of the threshold value voltage.

In this manner, in a current latch operation to be successively executed, when a signal current is supplied by column groups, and then, each current latch circuit portion 142 (latch circuit portion 142*a*) is caused to maintain an electric charge, a component equivalent to the threshold value voltage in the thin film transistors Ta4 and Ta5 that configure the above current mirror circuit is pre-charged in the capacitor CA. This makes it possible to speedily maintain an electric charge (voltage component) responsive to a signal current Ic; to reduce a current latch operation period, or to improve a delay of the current latch operation.

In other words, in the embodiment described above (reference should be made to FIGS. 8 and 9), operations are sequentially repeated for dividing display pixels configuring a display pixel array into a plurality of column groups and capturing and holding a signal current responsive to display data by column groups via external terminals, the number of which is equivalent to the number of columns included in the column groups, so as to maintain a signal current for one row in a current latch portion. Thus, a time permitted for a latch operation in each column group is restricted (occasionally reduced) in accordance with the number of column groups.

In addition, in the case where a display pixel array 110 (display pixel EM), a current latch circuit 140 and the like are configured by applying electric field effect type transistors (amorphous thin film transistors) using an amorphous silicon semiconductor layer on a substrate BASE, an operating speed may be reduced due to the transistor characteristics. Further, in the case where a current value of a signal current Ic is reduced based on low gradation display data, a delay of a current latch operation may occur.

Therefore, in the present embodiment (reference should be made to FIGS. 10 and 11), a voltage equivalent to a threshold value voltage of the thin film transistors Ta4 and Ta5 (or Tb4 and Tb5) is pre-charged in a capacitor CA (or CB) by means of a pre-charge operation, the thin film transistors configuring a current mirror circuit provided in each of the current latch circuit portions 142 (latch circuit portions 142*a* and 142*b*), for converting a signal current Ic into a voltage component, and then, generating a gradation current Ipix that has a predetermined current value. In this manner, a rapid latch operation can be achieved, thus making it possible to restrain degradation of image quality caused by lowering of a transistor operation speed or a signal delay.

In addition, in the present embodiment, a current ratio of the thin film transistors Ta4 and Ta5 or the thin film transistors Tb4 and Tb5 configuring a current mirror circuit is set at 1:x (x>1), whereby an operation of latching display data (signal current) in a current latch circuit (current latch portion) can be made speedily. Further, while a delay of the latch operation is restrained, a current value (absolute value) of a gradation current supplied to display pixels is increased, thereby making it possible to reliably carry out an operation of writing display data into display pixels.

<Specific Circuit Example of Display Pixels>

Referring now to the accompanying drawings, a description will be given with respect to a specific circuit example of display pixels that can be applied to a display device according to the present invention.

Figure 12:
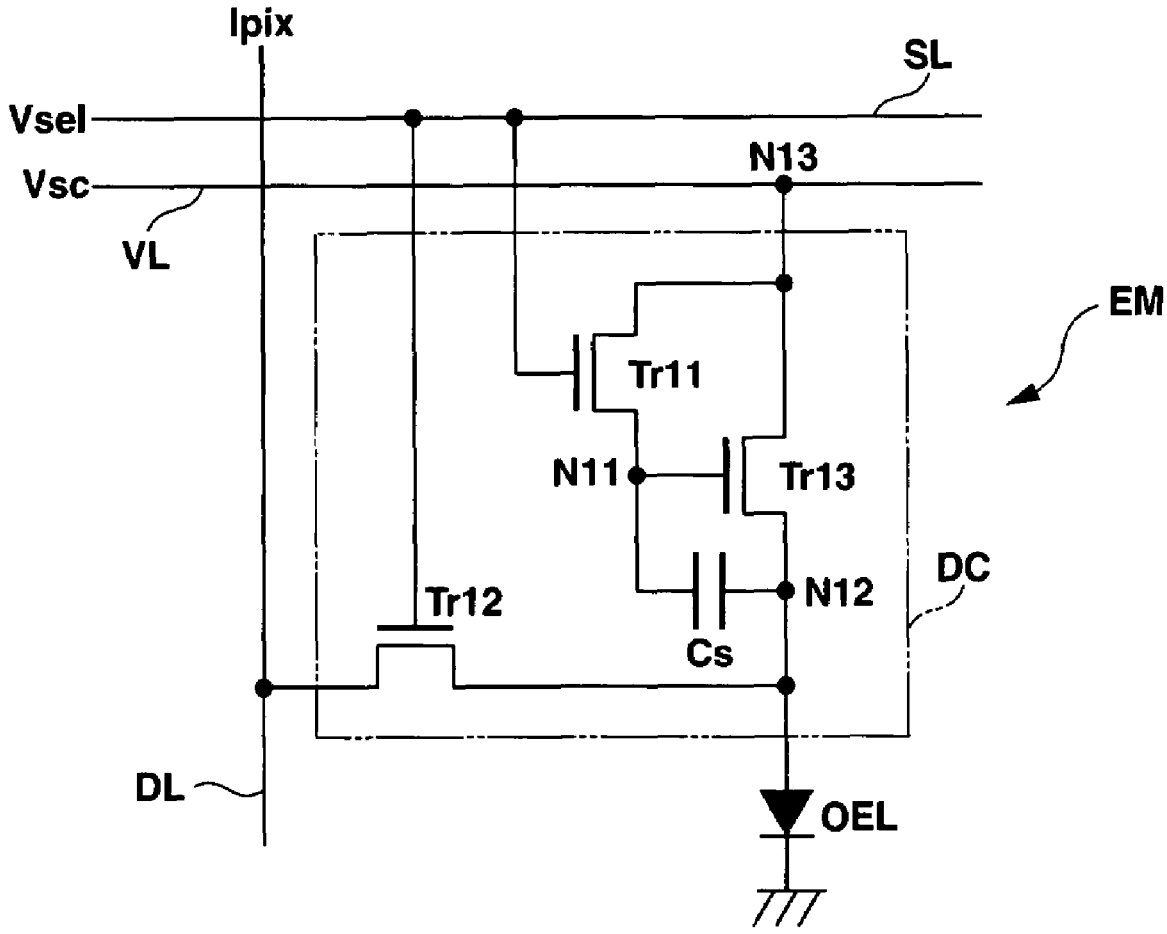
FIG. 12 is a view of a circuit configuration showing a specific example of display pixels that can be applied to the display device according to the present invention.

FIG. 12 is a circuit diagram depicting one specific example of display pixels that can be applied to the display device according to the present invention.

As shown in FIG. 12, display pixels EM that can be applied to the display device according to the present invention, in general, are composed to have: a pixel drive circuit DC for setting the display pixels EM at an active state, based on a scan signal Vsel applied from the scanning driver 120 described above, capturing a gradation current Ipix supplied from a current latch circuit 140 in the active state, and then, holding the captured current as a voltage component, and feeding to light emitting elements a light emitting drive current responsive to the gradation current Ipix; and current control type light emitting elements such as organic EL elements OEL that are operated to emit light at a predetermined luminance gradation (display gradation), based on a light emitting drive current supplied from the pixel drive circuit DC.

The pixel drive circuit DC, as shown in FIG. 12, for example, has a circuit configuration provided with: transistors Tr11 of which control terminals (gate terminals) are connected to scanning lines SL, current paths (source-drain) are connected to power supply lines VL (contact points N13) and contact points N11 that are applied by means of a power supply voltage Vsc; transistors Tr12 of which control terminals are connected to scanning lines SL and current paths are connected to data lines DL and contact points N12; transistors (light emitting drive transistors) Tr13 of which control terminals are connected to contact points N11 and current paths are connected to power supply lines VL and contact points N12; and a capacitor Cs connected between the contact point N11 and the contact point N12.

In the organic EL element OEL, an anode terminal is connected to a contact point N12 of the above pixel drive circuit DC, and a cathode terminal is connected to a grounding electric potential.

Here, n-channel type thin film transistors (electric field effect type transistors) can be applied to all of the transistors Tr11 to Tr13. In addition, the capacitor Cs is provided as a parasitic capacitor formed between a gate and a source of the transistor Tr13 or an auxiliary capacitor additionally formed between the gate and source.

<Drive Control Operation of Display Pixels>

Figure 13A:
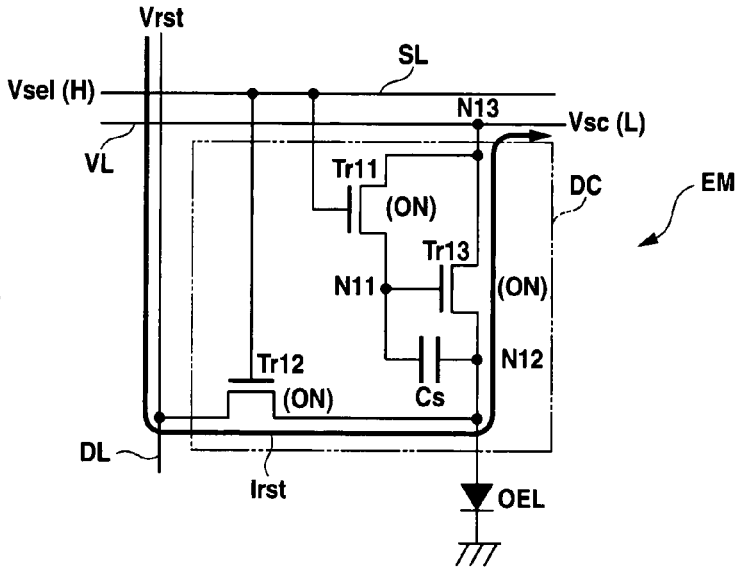
FIGS. 13A to 13C are conceptual views each showing a drive control operation of display pixels (pixel driving circuit) according to the present embodiment.
Figure 13B:
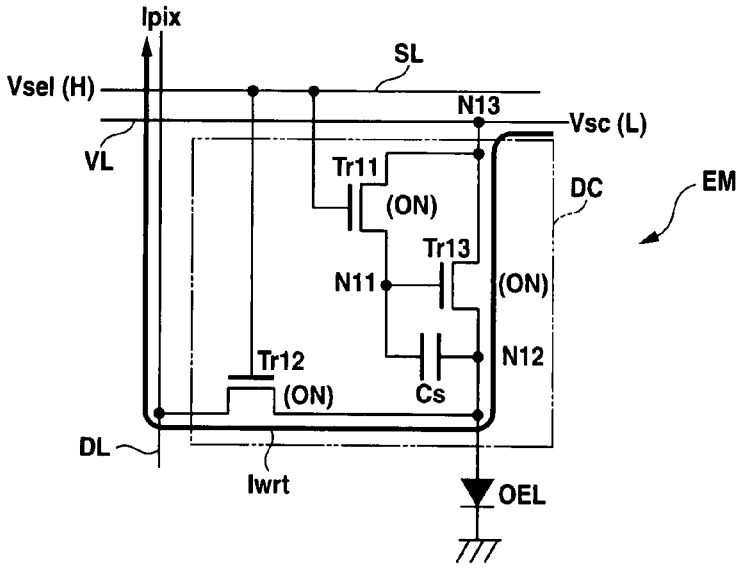
Figure 13C:
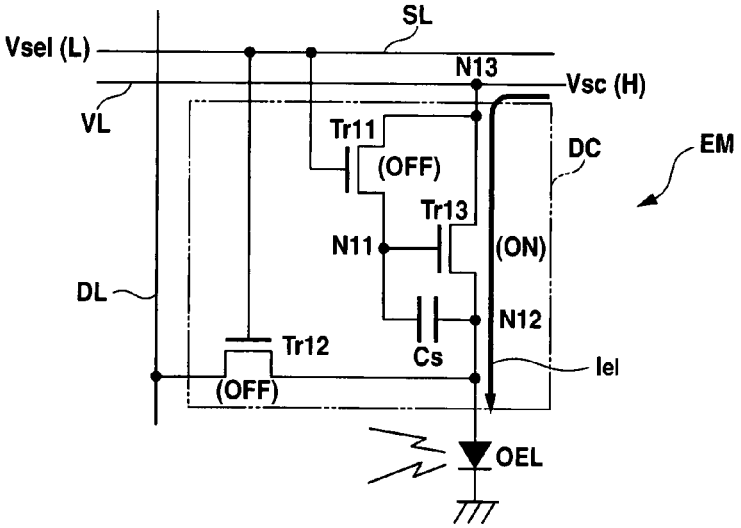

FIGS. 13A to 13C are conceptual views each showing a drive control operation of display pixels (pixel drive circuit) according to the present embodiment.

Here, a description will be given with appropriate reference to an operation of each section of the display device described above (reference should be made to FIGS. 5 to 9).

The light emitting drive control of light emitting elements (organic EL elements OEL) in the pixel drive circuit DC that has such a configuration is executed by setting: a reset operation period for setting display pixels EM at an active state, applying a reset voltage Vrst from the reset circuit 150 described above to data lines to discharge the electric charge that remains; a current write operation period for setting the display pixels EM at an active state, and then, supplying and writing a gradation current Ipix that corresponds to display data, from the current latch circuit 140 described above (holding the gradation current as a voltage component); and a light emitting operation period for setting the display pixels EM at a non-active state, supplying a light emitting drive current responsive to display data to the organic EL elements OEL, based on the voltage component written and held in the above current write operation period, and then, making a light emitting operation at a predetermined luminance gradation.

(Reset Operation Period)

In a reset operation (reset operation period), as has been described in the operation of the reset circuit 150 described above (reference should be made to FIGS. 7 and 9), a scan signal Vsel of a high level (H) is applied from a scanning driver 120 to scanning lines SL to set the display pixels at an active state and a power supply voltage Vsc of a low level (L) is applied to power supply lines VL, as shown in FIG. 13A. In addition, in synchronism with this timing, a predetermined reset voltage Vrst is applied from a reset circuit 150 (reset circuit portions 151*j*) to data lines DL.

In this manner, the transistors Tr11 and Tr12 turn ON, and then, a power supply voltage Vsc (for example, grounding electric potential) of a low level is applied to a contact point N11 (one end of each of gate terminal and capacitor Cs of transistor Tr13). In addition, a voltage level based on a reset voltage Vrst of a high electric potential applied to data lines DL is applied to a contact point N12 (the other end of each of source terminal and capacitor Cs of transistor Tr13). Thus, an electric potential difference occurs between the contact points N11 and N12 (between gate and source of transistor Tr13). Therefore, the transistor Tr13 turns ON, and then, a reset current Irst flows in power supply lines VL from the reset circuit 151*j* via the data lines DL, the transistor Tr12, the contact point N12, and the transistor Tr13.

At this time, the electric charge (voltage component) that is held in the capacitor Cs before the reset operation or that remains is discharged by applying the low level power supply voltage Vsc (for example, grounding electric potential) and the reset voltage Vrst to the contact points N11 and the N12. Further, the current state is set to a reset state (initialized state) in which the electric charge (voltage component) is accumulated, the electric charge corresponding to the electric potential difference required to feed the above reset current Irst between the contact points N11 and N12 (between gate and source of transistor Tr13).

(Current Write Operation Period)

In a current write operation (current write operation period), as has been described in the operation of the current latch circuit 14 described above (reference should be made to FIGS. 5 and 6), a scan signal Vsel of a high level (H) is applied from the scanning driver 120 to scanning lines SL to set display pixels EM at an active state and a power supply voltage Vsc of a low level (L) is applied to power supply lines VL, as shown in FIG. 13B. In addition, in synchronism with this timing, a gradation current Ipix with negative polarity responsive to display data is supplied from the current latch circuit 140 (latch circuit portion 142*a* or 142*b*) to data lines DL, specifically data line DLj.

In this manner, transistors Tr11 and Tr12 turn ON, and the low level power supply voltage Vsc (for example, grounding electric potential) is applied to a contact point N11. In addition, an operation of drawing (sampling) the gradation current Ipix in the current latch circuit 140 via the data lines DL is made, whereby a voltage level of an electric potential that is lower than the low level power supply voltage Vsc is applied to a contact point N12. Thus, an electric potential difference occurs between the contact points N11 and N12, whereby a transistor Tr13 turns ON, and then, a write current Ia corresponding to the gradation current Ipix flows from the power supply lines VL in the direction of the current latch circuit 150 via the transistor Tr13, the contact point N12, the transistor Tr12, and the data lines DL. In order to feed such a write current Ia, the low electric potential voltage Vee supplied to the current latch circuit portion 142 is set at a voltage level that is lower than the low level power supply voltage Vsc (for example, grounding electric potential).

At this time, an electric charge corresponding to the electric potential difference that has occurred between the contact points N11 and N12 is accumulated in a capacitor Cs, and then, the accumulated electric charge is held (charged) as a voltage component. In addition, the low level power supply voltage Vsc (for example, grounding electric potential) is applied to the power supply lines VL, and further, the write current Ia is controlled to flow in the direction of the data lines DL. Thus, the electric potential applied to the anode terminal (contact point N12) of the organic EL element OEL is lower than the electric potential of the cathode terminal (grounding electric potential). Furthermore, a reversed bias voltage is applied to the organic EL element OEL. Therefore, no light emitting drive current flows in the organic EL element OEL, and no light emitting operation is made.

(Light Emitting Operation Period)

In a light emitting operation (light emitting operation period), as shown in FIG. 13C, a scan signal Vsel of a low level (L) is applied from the scanning driver 120 to scanning lines SL; display pixels EM are set in an inactive state, and a power supply voltage Vsc of a high level (H) is applied to power supply lines (VL). In addition in synchronism with this timing, supply of a gradation current Ipix by the current latch circuit 140 is shut down, and then, a drawing operation is stopped.

In this manner, the transistors Tr11 and Tr12 turn OFF; applying of the power supply voltage Vsc to the contact point N11 is shut down, and applying of a voltage level exerted by the operation of drawing the gradation current Ipix into the contact point N12 is shut down. Thus, a capacitor Cs holds the electric charge accumulated in the current write operation period described above.

In this way, the capacitor Cs holds the electric charge (charge voltage) accumulated at the current write operation, whereby an electric potential difference of the contact points N11 and N12 (between gate and source of transistor Tr13) is held, and then, an electrically conductive state (ON state) is held such that the transistor Tr13 can feed a current of a current value responsive to a current value of a gradation current Idata. In addition, a power supply voltage Vsc having a voltage level that is higher than a grounding electric potential is applied to the power supply line VL, so that the electric potential applied to an anode terminal (contact point N12) of an organic EL element OEL is higher than an electric potential (grounding electric potential) of a cathode terminal.

Therefore, a light emitting drive current Ib flows from the power supply lines VL to the organic EL element OEL via the transistor Tr13 and the contact point N12 in a forward bias direction, and the organic EL element OEL emits light. Here, the electric potential difference (charge voltage) held by the capacitor Cs is equivalent to an electric potential difference in the case where a write current Ia corresponding to the gradation current Ipix in the transistor Tr13 is fed. Thus, a light emitting drive current Ib flowing in the organic EL element OEL has a current value equivalent to the above write current Ia (÷ gradation current Ipix).

In this manner, in the light emitting operation period, a voltage component is held, the voltage component being based on the gradation current Ipix responsive to the display data written in the current write operation period. Based on this current, the transistor Tr13 turns On in a saturation state, the light emitting drive current Ib is continuously supplied, and then, the organic EL element OEL continues an operation of emitting light at a luminance gradation responsive to display data.

In addition, a series of such drive control operations are sequentially repeatedly executed by lines with respect to all of the display pixels arranged in the display pixel array 110, whereby display data for one screen is written, light is emitted at a predetermined luminance gradation, and then, desired image information is displayed.

In particular, in a pixel drive circuit DC according to the present embodiment, the transistors Tr11 to Tr13 can be configured using thin film transistors, all of which has identical channel polarity (n-channel type). Thus, n-channel type electric field effect type transistors can be applied while an amorphous silicon semiconductor or a polysilicon semiconductor is defined as a channel layer like the current latch circuit 140 (current capturing circuit portion 141 or current latch circuit portion 142) and reset circuit 150 (reset circuit portions 151*j*) described above.

According to the present embodiment, together with the display pixel array 110 on which display pixels EM are arranged in a two-dimensional manner, the current latch circuit 140 and the reset circuit 150 described above can be integrally formed on a single substrate (display panel substrate) while a manufacturing process is used in common. In particular, in the case where the display pixel array 110 and the current latch circuit 140 or the reset circuit 150 are configured by applying an n-channel type electric field effect type transistor using an amorphous silicon semiconductor layer, electric field effect type transistors having stable operating characteristics can be manufactured comparatively inexpensively by applying the already established technique of manufacturing amorphous silicon. Thus, even in the case where the display pixel array (display panel) has high resolution or is large-sized, a display device having superior display image quality can be simply and properly provided.

Figure 14:
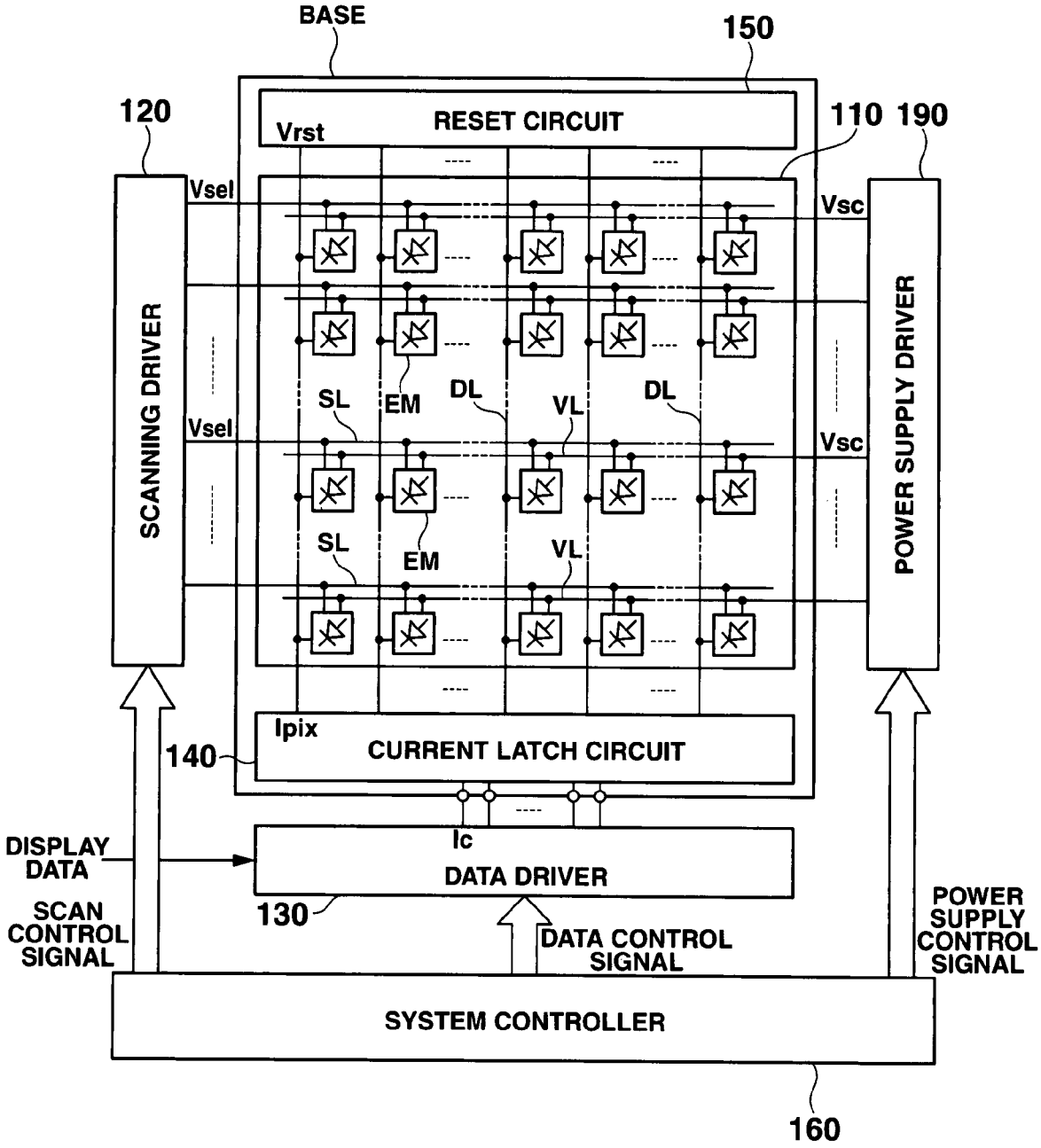
FIG. 14 is a schematic block diagram depicting an example of a configuration of the display device having display pixels applied thereto according to the present embodiment.

FIG. 14 is a schematic block diagram showing an exemplary configuration of a display device having applied thereto display pixels according to the present embodiment.

Figure 15:
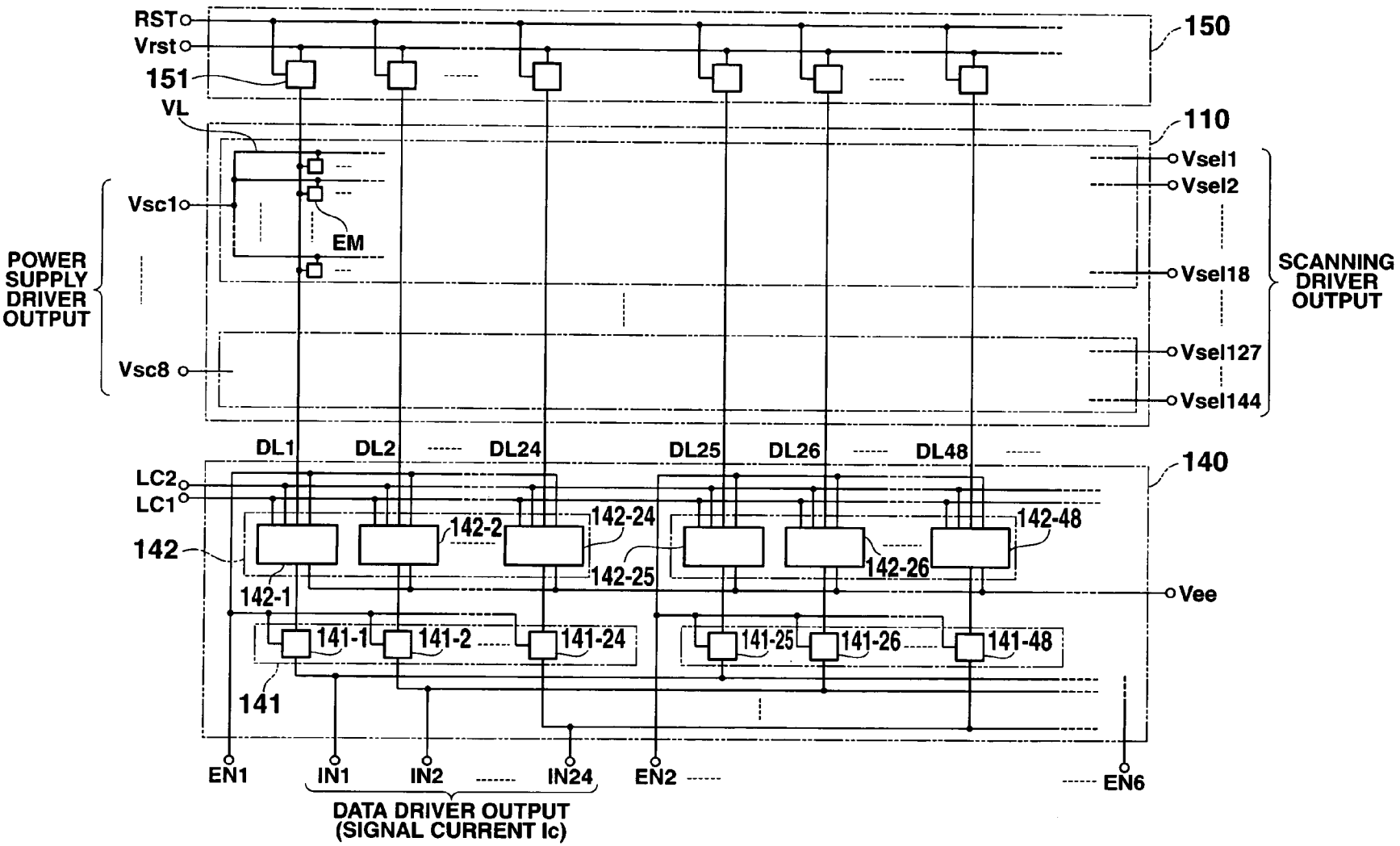
FIG. 15 is a structural view of essential portions showing another example of a configuration of the display device having display pixels applied thereto according to the present embodiment.
Figure 16:
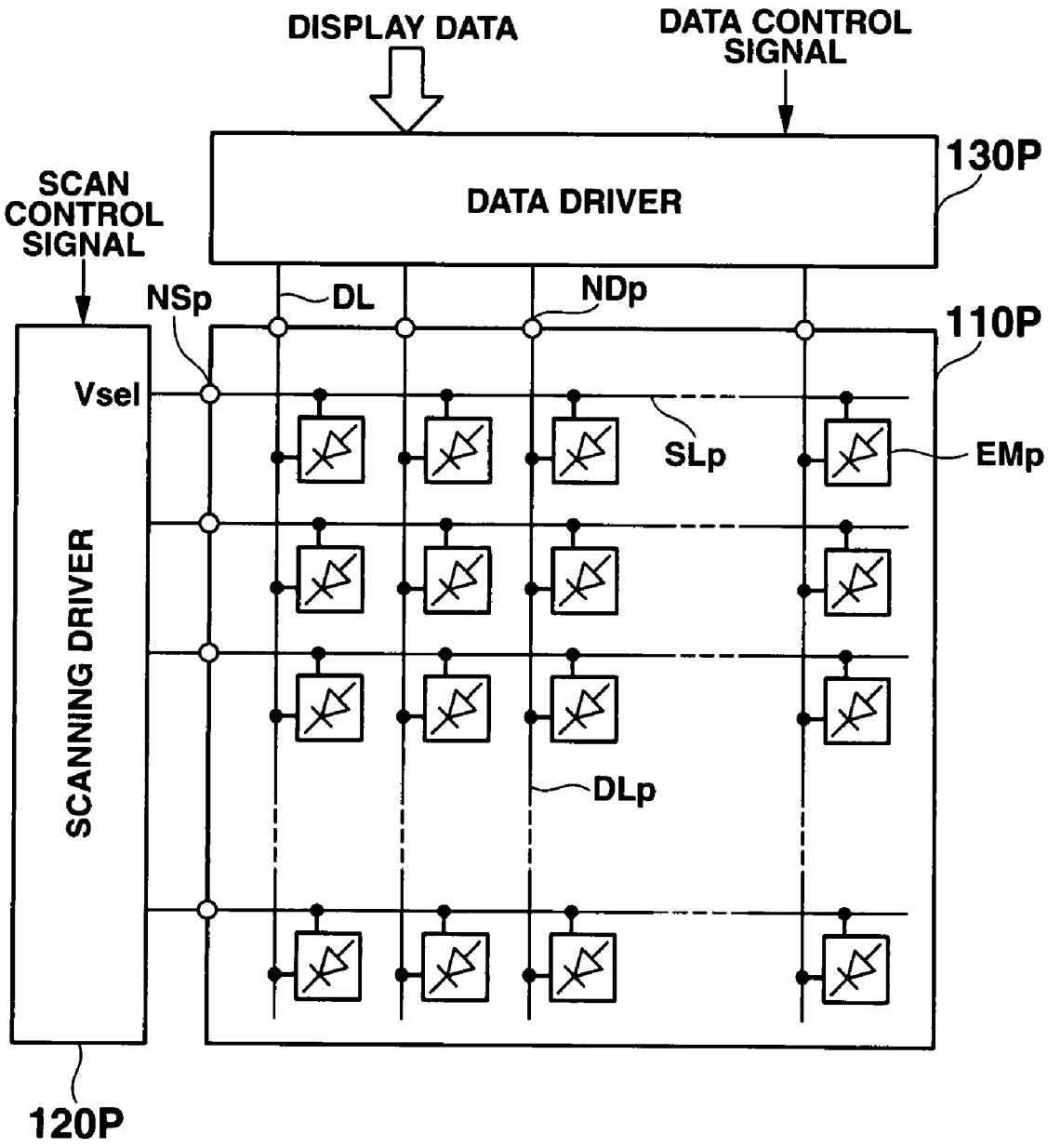
FIG. 16 is a schematic view showing an example of a configuration of essential portions of a light emitting element type display in a conventional technique.

FIG. 15 is a structural view of essential portions showing another example of a configuration of the display device having display pixels applied thereto according to the present embodiment.

Here, a detailed description will be given with respect to a configuration that is specific in the case where display pixels (pixel drive circuit) according to the present embodiment have been applied. Like configuration of the embodiment described above is not described here. In addition, in FIG. 15, as shown in the specific example described above, there is shown a case in which the display pixel array 110 has a pixel arrangement of 144 rows×144 columns.

One configuration of the display device having applied thereto the display pixels EM (pixel drive circuit DC) according to the embodiment described above, for example, as shown in FIG. 14, in addition to the configuration of the embodiment described above (reference should be made to FIGS. 1 and 2), can be properly provided with a power supply driver 190. The power supply driver 190 is connected via an external terminal, although not shown, to power supply lines VL arranged in parallel to scanning lines SL of rows of the display pixel array 110, the power supply driver applying to power supply lines VLi a power supply voltage Vcs having a voltage level serving as a reverse polarity relative to the scan signal Vsel in synchronism with a timing of outputting the scan signal Vsel from the scanning driver 120, based on a power supply control signal supplied from the system controller 160.

Here, the power supply driver 190 can apply a well known configuration provided with a shift register circuit and an output circuit (output buffer), like the scanning driver 120 described above, for example, (reference should be made to FIG. 2).

In addition, another exemplary configuration of the display device having applied thereto display pixels EM (pixel drive circuit DC) according to the embodiment described above is provided so that the display pixels EM arranged in the display pixel array 110 are grouped by rows, the number of which is equal to that of the display pixels (i.e., by scanning lines SL or by power supply lines VL), and then, a common power supply voltage Vsc is applied from the power supply driver 190 via an individual external terminal by row groups.

Specifically, for example, as shown in FIG. 15, the display pixel array 110 having a pixel arrangement of 144 rows×144 columns is divided into 8 groups (lines 1 to 18, lines 19 to 36, lines 37 to 54, lines 55 to 72, lines 73 to 90, lines 91 to 108, lines 109 to 126, and lines 127 to 144) per 18 rows (18 power supply lines VL). Individual power supply voltages Vsc (Vsc1 to Vsc8) are applied with different timings via individual external terminals from the power supply driver 190 by row groups. In this manner, the power supply voltage Vsc (for example, Vsc1) supplied via a single external terminal is applied at the same time to the display pixels for 18 rows included in row groups (for example, lines 1 to 18).

In a method for driving a display device having such a configuration, when high level scan signals are applied sequentially from a scanning line of a first line by means of a scanning driver, thereby sequentially setting display pixels of rows at an active state, and then, executing the reset operation and current write operation described above, the power supply voltage Vsc (for example, Vsc1) supplied via a single external terminal in association with the row group from the power supply driver is continuously set at a low level during a period in which any of the rows (for examples, rows 1 to 18) included in row groups is set at an active state.

In addition, at a time point when the current write operation responsive to display data has terminated by row groups, the power supply voltage Vsc applied in common to the row groups is set at a high level, whereby an operation is made such that the display pixels of rows included in the row groups emit light simultaneously sequentially from the row group in which the current write operation has terminated. Desired image information responsive to display data for one screen is displayed by repeating this light emitting operation.

While a circuit configuration provided with three transistors as pixel drive circuits DC has been shown in the display pixels EM described above, the present invention is not limited to the embodiment. Another circuit configuration may be provided as long as a pixel drive circuit applies a current specifying system. In addition, while a configuration having an organic EL element applied thereto has been shown as a light emitting element configuring the display pixels EM in the embodiment described above, the display device according to the present invention is not limited thereto. For example, another current control type light emitting element such as a light emitting diode can also be properly applied.

What is claimed is:

1. A display device comprising:

a pixel array in which a plurality of display pixels are arranged in a two-dimensional manner in the vicinity of cross points between a plurality of scanning lines arranged in a row direction and a plurality of data lines arranged in a column direction which is divided into a plurality of column groups composed of the display pixels of a predetermined number of columns;

a scan drive circuit which sequentially applies scan signals to each of the plurality of scanning lines, and then, selectively sets the display pixels of each row of the pixel array at an active state;

a signal drive circuit which produces a signal current that controls display gradation of the plurality of display pixels, based on display data, and then, sequentially outputs the signal current that corresponds to the display pixels for one row of the display array, via output terminals, the number of which is equal to the number of the columns included in the column group, by signal currents corresponding to each of the column groups; and a current latch circuit having input terminals, the number of which is equal to that of the output terminals, the input terminals being connected to the output terminals, and a plurality of current capturing circuit portions and current latch circuit portions that correspond to each of the plurality of column groups, the current latch circuit sequentially capturing the signal currents produced via the input terminals in each of the current latch circuits via each of the current capturing circuit portions; holding a signal current for one row of the pixel array and generating a gradation current that corresponds to the display pixels for one row of the pixel array, based on the held signal current, in parallel to each other, the current latch circuit simultaneously supplying the generated gradation current to the plurality of data lines in accordance with a timing of setting the display pixels of each row at an active state by the scan drive circuit; and wherein the pixel array and the current latch circuit are formed on a display panel substrate, and each of the output terminals of the signal drive circuit is electrically connected to each of the input terminals of the current latch circuit.

2. The display device according to claim 1, wherein each of the current latch circuit portions has two sets of latch circuit portions connected in parallel to each of the data lines of the pixel array, and each of the latch circuit portions has a current holding portion which holds an electric charge responsive to the signal current and a current output portion which generates and outputs the gradation current that corresponds to the signal current, based on the electric charge held in the current holding portion.

3. The display device according to claim 2, wherein the two sets of latch circuit portions in the current latch circuit portion is controlled such that an operation of holding the electric charge responsive to the signal current in the current holding portion in the one latch circuit portion and an operation of outputting the gradation current from the current output portion in the other latch circuit portion are made in parallel to each other.

4. The display device according to claim 1, further comprising a reset circuit which discharges an electric charge remaining in each of the plurality of display pixels, and then, sets the discharged electric charge at an initialized state prior to supplying the gradation current to the plurality of data lines.

5. The display device according to claim 1, wherein each of the display pixels arranged in the pixel array is provided with:

a pixel drive circuit which holds an electric charge responsive to the gradation current supplied from the current latch circuit, and then, generates a light emitting drive current having a predetermined current value, based on the electric charge; and a current control type light emitting element which operates to emit light at a predetermined luminance gradation, based on a current value of the light emitting drive current supplied from the pixel drive circuit.

6. The display device according to claim 5, wherein the current control type light emitting element is an organic electroluminescence element.

7. A driving method for controlling a display device so as to display image information responsive to display data, the method comprising:

the display device having a pixel array in which a plurality of display pixels are arranged in a two dimensional manner which is divided into a plurality of column groups composed of the display pixels of a predetermined number of columns, the pixel array being formed on a display panel substrate, and a current latch circuit formed on the display panel substrate which generates a gradation current that is based on display data, and then, supplies the generated gradation current to the plurality of display pixels;

by means of a signal drive circuit provided outside the display panel substrate, generating a signal current for controlling display gradation of the display pixels of each row of the pixel array, based on the display data, and then, sequentially outputting, in time series via a common terminals, the signal current that corresponds to the display pixels for one row of the pixel array by signal currents that correspond to each of the column groups; and by means of a current latch circuit, sequentially capturing the signal currents, holding the signal current for one row of the pixel array, generating the gradation currents that correspond to the display pixels for one row of the pixel array, based on the held signal current, and then, simultaneously supplying the generated gradation currents to each of the display pixels of the row.

8. The driving method according to claim 7, further including an operation of sequentially setting the display pixels of each row of the pixel array at an active state by means of a scan drive circuit, wherein supply of the gradation current from the current latch circuit to the display pixels is carried out by means of the scan drive circuit in accordance with a timing of setting the display pixels of each row at an active state.

9. The driving method according to claim 7, wherein an operation of capturing and holding each of the signal currents includes an operation of holding an electric charge responsive to each signal current of the signal currents.

10. The driving method according to claim 9, wherein generation of the gradation current is carried out based on an electric charge held in response to each of the signal currents.

11. The driving method according to claim 7, wherein an operation of capturing and holding the signal currents and an operation of supplying the gradation current to each of the display pixels are executed in parallel to each other.

12. The driving method according to claim 7, further including an operation of discharging an electric charge remaining in each of the plurality of display pixels, and then, setting the discharged electric charge at an initialized state prior to an operation of supplying the gradation current to the display pixels.

13. The driving method according to claim 7, further including an operation of applying a predetermined precharge voltage to the current latch circuit prior to an operation of capturing and holding the signal currents.

14. A display device comprising:

a pixel array in which a plurality of display pixels are arranged in a two-dimensional manner in the vicinity of cross points between a plurality of scanning lines arranged in a row direction and a plurality of data lines arranged in a column direction which is divided into a plurality of column groups composed of the display pixels of a predetermined number of columns;

a signal drive circuit, produces a signal current for controlling display gradation of the plurality of display pixels based on display data, and sequentially outputs, in time series via a common terminals, the signal current that corresponds to the display pixels for one row of the pixel array for each of signal currents that correspond to each of the column groups; and a current latch circuit which sequentially captures the signal currents output from the signal drive circuit, holds the signal current for one row of the pixel array, generates gradation currents that correspond to the display pixels for one row of the pixel array, based on the held signal current, and then, simultaneously supplies the generated gradation currents to the plurality of data lines, wherein the pixel array and the current latch circuit are formed on a display panel substrate.

15. The display device according to claim 14, wherein the signal drive circuit has output terminals as the common terminals, the number of which is equal to the number of the columns included in the column group, and the signal currents are sequentially output via the output terminals.

16. The display device according to claim 15, wherein the current latch circuit has input terminals, the number of which is equal to that of the output terminals, the input terminals being electrically connected to the output terminals of the signal drive circuit, and sequentially captures the signal currents via the input terminals.

17. The display device according to claim 14, further comprising a scan drive circuit which sequentially applies a scan signal to each of the plurality of scanning lines, and then, sequentially sets the display pixels of rows of the pixel array at an active state, wherein an output of the gradation current from the current latch circuit to the plurality of data lines is provided by means of the scan drive circuit in accordance with a timing of setting the display pixels of rows at an active state.

18. The display device according to claim 14, wherein the current latch circuit is composed of a plurality of current capturing circuit portions and current latch circuit portions provided in association with each of the plurality of column groups, each of the current capturing circuit portions captures the signal currents, and each of the current latch circuits holds the captured signal current and generates the gradation current that corresponds to the held signal current, and then, outputs the generated gradation current to each of the data lines.

19. The display device according to claim 18, wherein each of the current latch circuit portions has two sets of latch circuit portions connected in parallel to each of the data lines of the pixel array, and each of the latch circuit portions has a current holding portion which holds an electric charge responsive to the signal current and a current output portion which generates and outputs the gradation current that corresponds to the signal current, based on the electric charge held in the current holding portion.

20. The display device according to claim 19, wherein the two sets of latch circuit portions in the current latch circuit portion are controlled such that an operation of holding the electric charge responsive to the signal current in the current holding portion in the one latch circuit portion and an operation of outputting the gradation current from the current output portion in the other latch circuit portion are made in parallel to each other.

21. The display device according to claim 19, wherein the current holding portion is configured to have a first transistor of which the signal current flows in a current path, whereby an electric potential responsive to a current value of the signal current is produced at a control terminal, and an electric charge accumulator circuit which accumulates the electric charge responsive to an electric potential difference produced between the control terminal and the current path of the first transistor, the current output portion is configured to have a second transistor of which an electric potential based on the electric charge accumulated in the electric charge accumulator circuit is applied to the control terminal, whereby the gradation current having a predetermined circuit value flows in a current path, and the first transistor and the second transistor configure a current mirror circuit.

22. The display device according to claim 21, further comprising a pre-charge circuit which applies a predetermined pre-charge voltage to the current holding portion and the current output portion of the current latch circuit portion.

23. The display device according to claim 22, wherein the pre-charge circuit causes the electric charge accumulator circuit to accumulate an electric charge equivalent to a threshold value voltage of each of the first transistor and the second transistor that configure the current holding portion and the current output portion of the current latch circuit.

24. The display device according to claim 14, further comprising a reset circuit which discharges an electric charge remaining in each of the plurality of display pixels, and then, sets the discharged electric charge at an initialized state prior to supplying the gradation current to the plurality of data lines.

25. The display device according to claim 14, wherein each of the display pixels arranged in the pixel array is provided with:

a pixel drive circuit which holds an electric charge responsive to the gradation current supplied from the current latch circuit, and then, generates a light emitting drive current having a predetermined current value, based on the electric charge; and a current control type light emitting element which operates to emit light at a predetermined luminance gradation, based on a current value of the light emitting drive current supplied from the pixel drive circuit.

26. The display device according to claim 25, wherein the current control type light emitting element is an organic electroluminescence element.

* * * * *